US005419685A

United States Patent [19]

Fujii et al.

[11] Patent Number: 5,419,685

[45] Date of Patent: May 30, 1995

[54] RECIPROCATING-PISTON-TYPE REFRIGERANT COMPRESSOR WITH A ROTARY-TYPE SUCTION-VALVE MECHANISM

[75] Inventors: Toshiro Fujii; Hiromi Kitayama; Koichi Ito; Kazuya Kimura; Hiroaki Kayukawa, all of Kariya, Japan

[73] Assignee: Kabushiki Kaisha Toyoda Jidoshokki Seisakusho, Aichi, Japan

[21] Appl. No.: 191,456

[22] Filed: Feb. 3, 1994

Related U.S. Application Data

[63] Continuation-in-part of Ser. No. 103,888, Aug. 6, 1993, abandoned.

[30] Foreign Application Priority Data

Aug. 7, 1992 [JP] Japan ..... 4-211165
Aug. 7, 1992 [JP] Japan ..... 4-211166
Sep. 16, 1992 [JP] Japan ..... 4-246925

[51] Int. Cl.[6] ..... F04B 1/12
[52] U.S. Cl. ..... 417/269; 91/484
[58] Field of Search ..... 417/269; 91/480, 484; 184/6.17

[56] References Cited

U.S. PATENT DOCUMENTS 1,367,914 2/1921 Larsson .
1,925,378 9/1933 Ferris et al. ..... 91/484 X
4,475,443 10/1984 Forster ..... 91/499
5,286,173 2/1994 Takenaka et al. ..... 417/269

FOREIGN PATENT DOCUMENTS 350135 3/1921 Germany .
0101172 1/1983 Japan ..... 417/269

*Primary Examiner*—Richard A. Bertsch
*Assistant Examiner*—William Wicker
*Attorney, Agent, or Firm*—Burgess, Ryan & Wayne

[57] ABSTRACT

A reciprocating-piston-type refrigerant compressor having a cylinder block having a plurality of cylinder bores in which a plurality of pistons reciprocate to effect suction, compression and discharge of refrigerant gas in response to rotation of a drive shaft, a gas receiving chamber for receiving the refrigerant gas before compression, a gas discharge chamber for receiving the compressed refrigerant gas, and at least one rotary valve element mounted on the drive shaft to be rotatable with the drive shaft and having a suction passageway for providing a fluid communication between the gas receipt chamber and each of a compression chambers formed in the plurality of cylinder bores so that the refrigerant gas before compression is sequentially drawn into the compression chambers during the rotation of the rotary valve element.

18 Claims, 15 Drawing Sheets

RECIPROCATING-PISTON-TYPE REFRIGERANT COMPRESSOR WITH A ROTARY-TYPE SUCTION-VALVE MECHANISM

RELATED APPLICATIONS

This application is a continuation-in-part of U.S. application Ser. No. 08/103,888 filed Aug. 6, 1993, and now abandoned.

BACKGROUND OF THE INVENTION

1. Field of the Invention

The present invention relates to a reciprocating-piston-type refrigerant compressor provided with a refrigerant-gas-suction mechanism improved so as to increase the volumetric compression efficiency thereof compared to a conventional recriprocating-piston-type refrigerant compressor provided with a flapper-type suction-valve mechanism. More particularly, it relates to a reciprocating-piston-type refrigerant compressor provided with a rotary-type suction-valve or valves mounted on a drive shaft so as to be rotated together with the drive shaft thereby permitting refrigerant gas to be drawn into each of a plurality of compression chambers in response to reciprocation of the pistons.

2. Description of the Related Art

Various reciprocating-piston-type refrigerant compressors such as a swash-plate-operated reciprocating-piston-type refrigerant compressor, and a wobble-plate-type reciprocating-piston-type refrigerant compressor are known.

Japanese Unexamined Patent Publication (KoKai) No. 3-92587 (JP-A-3-92587) discloses a typical conventional swash-plate-operated reciprocating-piston-type refrigerant compressor provided with a cylinder block having a plurality of axial cylinder bores in which pistons are axially reciprocated in response to the butation of a swash-plate about the axis of rotation of its drive shaft. The swash-plate is housed in a swash-plate chamber centrally formed in the cylinder block. The swash-plate chamber is also used for receiving refrigerant gas when it returns from the external refrigeration circuit.

The above-mentioned compressor is further provided with flapper-type suction-valves which are used to open and close suction ports arranged between respective compression chambers defined by the reciprocating-pistons in the cylinder bores and a pair of suction chambers (the front and rear suction chambers) for receiving the refrigerant gas before compression, and fluidly communicated with the above-mentioned swash-plate chamber via suction passageways. The refrigerator gas before compression is drawn into respective compression chambers through the suction ports via the opening flapper-type suction-valves during the suction stroke of respective reciprocating-pistons moving from the top dead center to the bottom dead center thereof. When respective reciprocating-pistons implement the compression and discharge stroke thereof by moving from the bottom dead center to the top dead center thereof in the cylinder bores, respectively, the flapper-type suction-valves are closed. The refrigerant gas is compressed in the compression chamber, and discharged therefrom into a pair of discharge chambers (the front and rear discharge chambers) via the opening flapper-type discharge valves which arranged so as to open and close discharge ports formed between the compression chambers and the discharge chambers.

The opening and closing of the flapper-type suction-valves are caused by a pressure differential between the suction chambers and respective compression chambers in the cylinder bores. Names, when pressure prevailing in the suction chambers is higher than that in the compression chambers due to the suction stroke of the reciprocating-pistons, the flapper-type suction-valves are bent by the pressure differential to move toward the opening position thereof opening the suction ports.

Since the flapper-type suction-valves are made of elastic material to show resilience when bending, such resilience of the flapper-type suction-valves acts as an elastic resistance against movement of respective suction-valves. Accordingly, the opening of the flapper-type suction-valves does not occur before the above-mentioned pressure differential between the suction chambers and the compression chambers becomes larger than a predetermined level. Thus, the motion of opening of the flapper-type valves cannot be quick enough for achieving an instant suction of the refrigerant gas into the compression chambers.

Further, the above-described reciprocating-piston-type refrigerant compressors are generally supplied with a lubricating oil in the form of oil mist suspended in the refrigerant gas in order to lubricate the internal elements of the compressor. Thus, the lubricating oil suspended in the refrigerant gas is distributed to many of the internal portions of the compressor by flowing together with the refrigerant gas. As a result the lubricating oil, suspended in the refrigerant gas as an oil mist, can be carried toward and attack to faces of the flapper-type suction-valves as well as wall portions surrounding the suction ports and contacted by the flapper-type suction-valves. Thus, when the lubricating oil attaches to the flapper-type suction-valves and the wall portions surrounding the suction ports, it is so viscous as to prevent quick opening of the flapper-type suction-valves from the closing position thereof contacting the wall portions. Accordingly, the quick opening of the flapper-type suction-valves is prevented due to the attachment of the lubricating oil to both the flapper-type suction-valves and the wall portions.

Since the flapper-type suction-valves of the conventional refrigerant compressor are not able to open quickly in response to a pressure differential between the suction chambers and the compression chambers, the amount of flow of the refrigerant gas from the suction chambers into the compression chambers is reduced, and accordingly, the volumetric efficiency in the compression of the refrigerant gas by the conventional reciprocating-piston-type refrigerant compressor using the flapper-type suction-valves is made small. Furthermore, when the flapper-type suction-valves are opened so as to permit suction of the refrigerant gas into the compression chambers, the resilience of the suction-valves per se acts as resistance against the suction of the refrigerant gas, and thus, the amount of suction of the refrigerant gas is further reduced.

In the described conventional swash-plate-operated reciprocating-piston-type compressor, the plurality of axial cylinder bores of the cylinder block are arranged around the axis of rotation of the drive shaft with an equi-angular distance between the two neighboring cylinder bores. Nevertheless, when the angular distance between the two neighbouring cylinder bores is set small, the thickness of a separating rigid portion between the two neighbouring cylinder bores is reduced to thereby weaken the physical strength of the cylinder block. Moreover, when the suction passageways for the refrigerant gas flow from the swash-plate chamber to the suction chambers are provided in the separating rigid portions as disclosed in JP-A-3-92587, the formation of such suction passageways will further weaken the physical strength of the cylinder block.

When the angular distance between the two neighbouring cylinder bores is set large to obtain a thick separating rigid portion in the cylinder block, respective cylinder bores must be arranged along a circle having a large radius about a center lying in the axis of rotation of the drive shaft. Therefore, such large radius of the circle along which the cylinder bores are arranged will bring about an increase in the physical size of the compressor.

Nevertheless, when the radius of the circle along which the cylinder bores are arranged is made small to reduce the diametrical size of the cylinder block, the angular distance between the two neighbouring cylinder bores must be necessarily reduced, and accordingly, the circumferentially thickness of respective rigid portions between the two neighbouring cylinder bores is reduced to thereby weaken the physical strength of the cylinder block, as described before. Consequently, it is difficult to reduce the size of the compressor.

In addition, the provision of the suction passageways in the rigid portions between the two neighbouring cylinder bores of the cylinder block is apt to cause loss of pressure of the compressed refrigerant gas, and accordingly, the compression efficiency of the compressor is further reduced.

Further, when the reciprocating-piston-type compressor is incorporated in a car refrigerating system, the drive shaft of the compressor is rotated by a car engine via a power transmission means such as an solenoid clutch. When the compressor is initially started, a power transmission means is operated to connect the drive shaft of the compressor with the car engine. As soon as the car engine is connected to the compressor, the compressor immediately starts the compression operation thereof, and therefore a large load attributed to the start of the operation of the compressor is suddenly applied to the car engine. Accordingly, the car must be subjected to a sudden change in the drive power, and a driver and passengers must experience shock and discomfort. Also, generation of noise occurs.

At the start of the refrigerant compressor after a long stop, the refrigerant gas is often liquefied. Thus, when the compressor starts, the liquefied refrigerant is pumped during the initial stage of the operation of the compressor. Such pumping of the liquefied refrigerant applies a large load to the car engine.

SUMMARY OF THE INVENTION

An object of the present invention is to provide a reciprocating-piston-type refrigerant compressor having a high volumetric efficiency in the compression of the refrigerant gas.

Another object of the present invention is to provide a reciprocating-piston-type refrigerant compressor capable of reducing the diameter of the compressor body.

A further object of the present invention is to provide a reciprocating-piston-type refrigerant compressor employing a rotary-type suction-valve or valves capable of eliminating defects encountered by the conventional reciprocating-piston-type refrigerant compressor using the flapper-type suction valves.

A still further object of the present invention is to provide a reciprocating-piston-type refrigerant compressor employing a rotary-type suction-valve or valves thereby capable of reducing the starting shock of the compressor at the start of the operation of the compressor when it is incorporated in a car refrigerating system.

In accordance with one aspect of the present invention, there is provided a reciprocating-piston-type refrigerant compressor provided with a body including a cylinder block, an axial drive shaft rotatably supported in the body, at least one gas receiving chamber formed in the body for receiving refrigerant gas before compression, at least one gas discharging chamber formed in the body for receiving compressed refrigerant gas, a plurality of axial cylinder bores formed in the cylinder block of the body and arranged around an axis of rotation of the drive shaft, and a plurality of reciprocating-pistons axially slidably received in the plurality of cylinder bores and reciprocating in response to the rotation of the swash-plate drive shaft, the reciprocating-pistons defining compression chambers in the plurality of cylinder bores, the compressor comprising:

a rotary valve unit arranged to be rotatable with the drive shaft and having a suction passageway for permitting suction of the refrigerant as before compression from the gas receipt chamber into respective compression chambers in a timed relationship with the reciprocation of the reciprocating pistons during the rotation of the rotary valve unit:

a unit for defining a recessed chamber in the body for rotatably receiving the rotary valve unit, the recessed chamber being surrounded by an inner wall axially slanted and circumferentially extending around the axis of rotation of the drive shaft;

the rotary valve unit being provided with an outer circumferential wall axially slanted so as to form two axially opposite small and large diameter end portions thereof, the outer circumferential wall being slidably fit in the inner wall of the recessed chamber; and a unit for providing a generally axial force on the rotary valve unit thereby urging the rotary valve unit in the recessed chamber in a direction such that the outer circumferential wall of the rotary valve unit is in sealing contact with the inner wall of the recessed chamber.

Preferably, the rotary valve unit is provided with two pressure receiving ends disposed at the small and large diameter end portions of the outer circumferential wall, and two different pressures of the refrigerant gas are applied to the two pressure receipt ends of the rotary valve unit. A pressure differential between the two different pressures applied on the two pressure receipt ends urges the rotary valve unit in the direction such that the outer circumferential wall of the rotary valve unit is in sealing contact with the inner wall of the recessed chamber.

The suction passageway of the rotary valve unit is typically formed in the outer circumferential wall and has a gas inlet aperture opening toward the gas receipt chamber and a gas outlet aperture capable of opening toward each of the plurality of compression chambers in the plurality of cylinder bores in the timed relationship with the reciprocation of the reciprocating-pistons.

The two different pressures of the refrigerant gas are pressure of the refrigerant gas in the gas receipt chamber and pressure of the refrigerant gas in the gas discharge chamber.

The rotary valve unit is axially slidably mounted on the drive shaft, and one of the two pressure receipt ends which is disposed at the small diameter end portion of the outer circumferential wall of the rotary valve unit is exposed to the gas receipt chamber and the other of the two pressure receipt ends which is disposed at the large diameter end portion of the outer circumferential wall of the rotary valve unit is exposed to the gas discharge chamber.

Preferably, the reciprocating-piston-type refrigerant compressor is further provided with an elastic unit for applying a generally axial elastic force to the rotary valve unit in a direction against the above-mentioned axial force applied by the unit for providing axial force. The axial elastic force urges the outer circumference of the rotary valve unit to move away from the inner wall of the recessed chamber when the pressure differential between the two different pressures applied on the two pressure receipt ends of the rotary valve unit is smaller than a predetermined level.

Preferably, at least one of the outer circumferential wall of the rotary valve unit and the inner wall of the recessed chamber is provided with a grooved recess for supplying the outer circumferential and inner walls with lubricant oil suspended in the refrigerant gas before compression and the compressed refrigerant gas.

In accordance with another aspect of the present invention, there is provided a reciprocating-piston-type refrigerant compressor provided with a body including a cylinder block having a plurality of axial cylinder bores formed therein so as to be arranged around an axis of rotation of a drive shaft rotatably supported in the body, a swash-plate mounted on the drive shaft to be rotated together with the drive shaft, a plurality of double-headed reciprocating-pistons axially slidably received in the plurality of cylinder bores and reciprocating in response to the rotation of the swash-plate, the double-headed pistons defining a pair of compression chambers in each of the plurality of cylinder bores, a gas receiving chamber formed in the body for receiving refrigerant gas before compression, axially spaced discharge chambers formed in said body, respectively, for receiving compressed refrigerant gas, the compressor comprising:

rotary valve elements mounted on axially spaced positions of the axial drive shaft to be rotatable with the drive shaft, each rotary valve element having a suction passageway for permitting suction of the refrigerant gas before compression from the gas receipt chamber into one of the pair of compression chambers of the plurality of cylinder bores in a timed relationship with the reciprocation of the reciprocatory double-headed pistons during rotation of the rotary valve element;

a unit for defining recessed chambers in the body for rotatably receiving the rotary valve elements, each of the recessed chambers being surrounded by an inner wall axially slanted and circumferentially extending around the axis of rotation of the drive shaft;

each of the rotary valve elements being provided with an outer circumferential wall axially slanted so as to form two axially opposite small and large diameter end portions thereof, the outer circumferential wall being slidably fit in the inner wall of one of the recessed chambers; and a unit for applying pressure of the refrigerant gas before compression to the small diameter end portion of each of the rotary valve elements and for applying pressure of the compressed refrigerant gas to the large diameter end portion of each of the rotary valve elements to thereby move the rotary valve element in each of the recessed chambers in a direction such that the outer circumferential wall of the rotary valve element is in sealing contact with the inner wall of the recessed chamber.

BRIEF DESCRIPTION OF THE DRAWINGS

The above and other objects, features and advantages of the present invention will be made more apparent from the ensuing description of the preferred embodiments thereof in conjunction with the accompanying drawings wherein:

Referring to FIG. 1, the reciprocating-piston-type compressor is provided with a pair of front and rear cylinder blocks 1 and 2 combined together to form a main part of an axially extending compressor body. The cylinder blocks 1 and 2 of the body are centrally formed with later-described valve receiving chambers 1*a* and 2*a* in the form of a conically recessed through-bore, respectivly.

Figure 1:
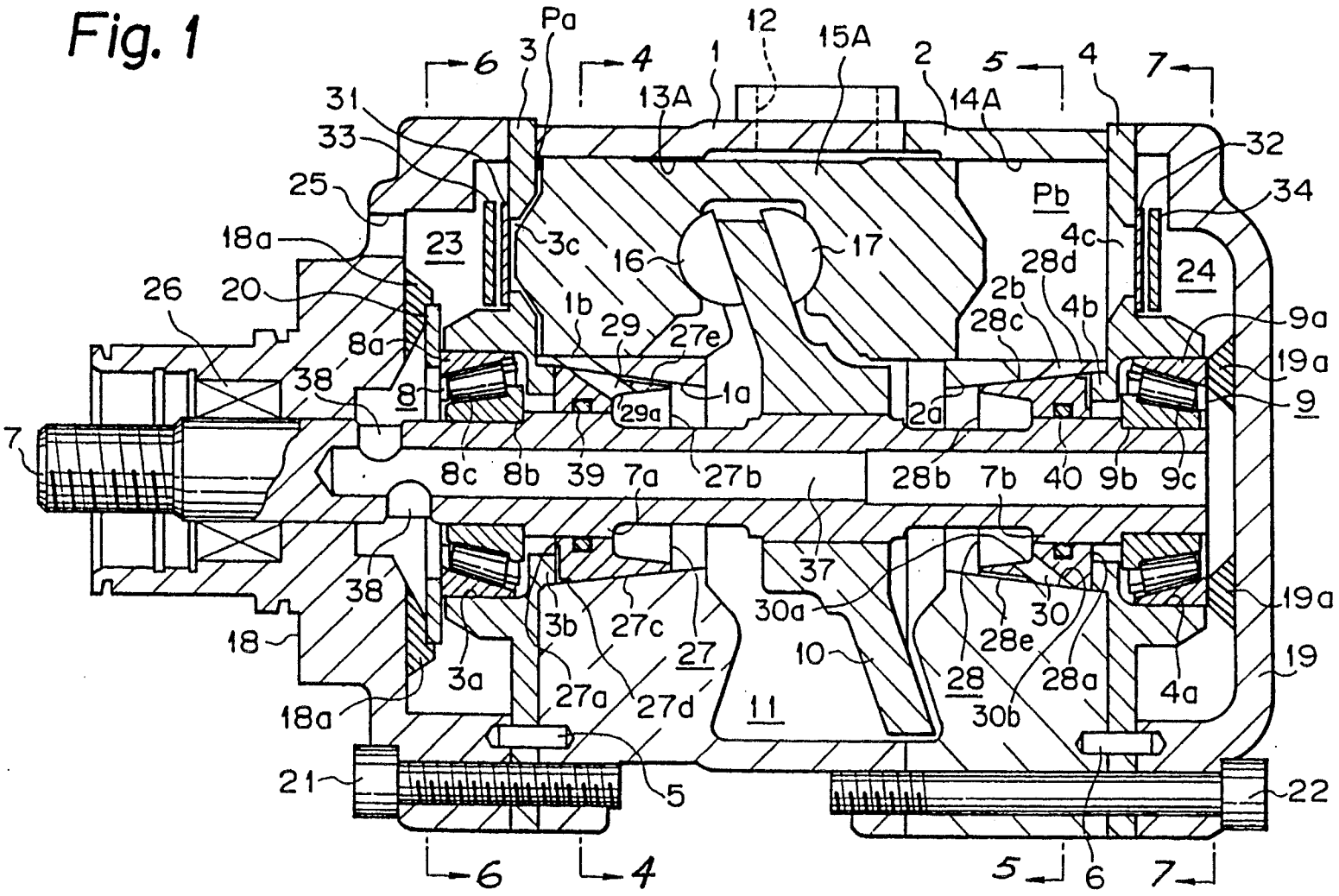
FIG. 1 is a longitudinal cross-sectional view of a reciprocating-piston-type compressor according to a first embodiment of the present invention, illustrating an internal construction thereof.

The connected cylinder blocks 1 and 2 have axially opposite ends, i.e., front and rear (left-hand and right-hand) ends to which front and rear valve plates 3 and 4 are air-tightly attached, respectively. The front and rear valve plates 3 and 4 are centrally provided with respective boss portions in which bearing receipt bores 3*a* and 4*a* in the form of a through-bore are formed, respectively. The valve plates 3 and 4 are also centrally provided with annular positioning projections 3*b* and 4*b*, respectively, which axially inwardly project so a to be engaged in the lip of the valve receiving chambers 1*a* and 2*a* of the front and rear cylinder blocks 1 and 2. The annular positioning projections 3*b* and 4*b* are formed so as to be substantially coaxial with the bearing receipt bores 3*a* and 4*a*, respectively. The valve plates 3 and 4 are fixed to the ends of the connected cylinder blocks 1 and 2 by pins 5 and 6, respectively, so that both valve plates 3 and 4 cannot be rotated with regard to the cylinder blocks 1 and 2.

An axial drive shaft 7 extends through the center of the connected cylinder blocks 1 and 2, and is rotatably supported by tapered-roller bearings 8 and 9 received in the above-mentioned bearing receipt bores 3*a* and 4*a* of the front and rear valve plates 3 and 4, respectively. The tapered-roller bearings 8 and 9 are provided with outer races 8*a* and 9*a*, inner races 8*b* and 9*b*, and a plurality of tapered-rollers 8*c* and 9*c*, and are able to accept both radial and thrust forces.

A swash-plate 10 is fixedly mounted on the drive shaft 7 so that the swash-plate 10 is rotated together with the drive shaft 7 in a swash-plate chamber 11 which is axially centrally formed in the connected cylinder blocks 1 and 2. The cylinder blocks 1 and 2 are also provided with gas inlet ports 12 formed in the axially central portion of the cylinder blocks 1 and 2 so as to be communicated with the swash-plate chamber 11, and the gas inlet port 12 is connected to a gas inlet pipe of an external refrigerating circuit when the compressor is incorporated in the refrigerating system.

Figure 3:
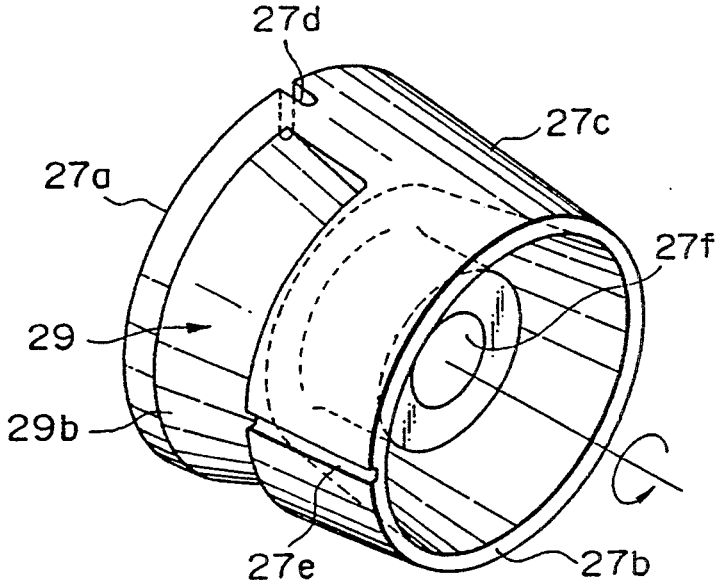
FIG. 3 is a perspective view of the rotary valve element of FIGS. 1 and 2.
Figure 4:
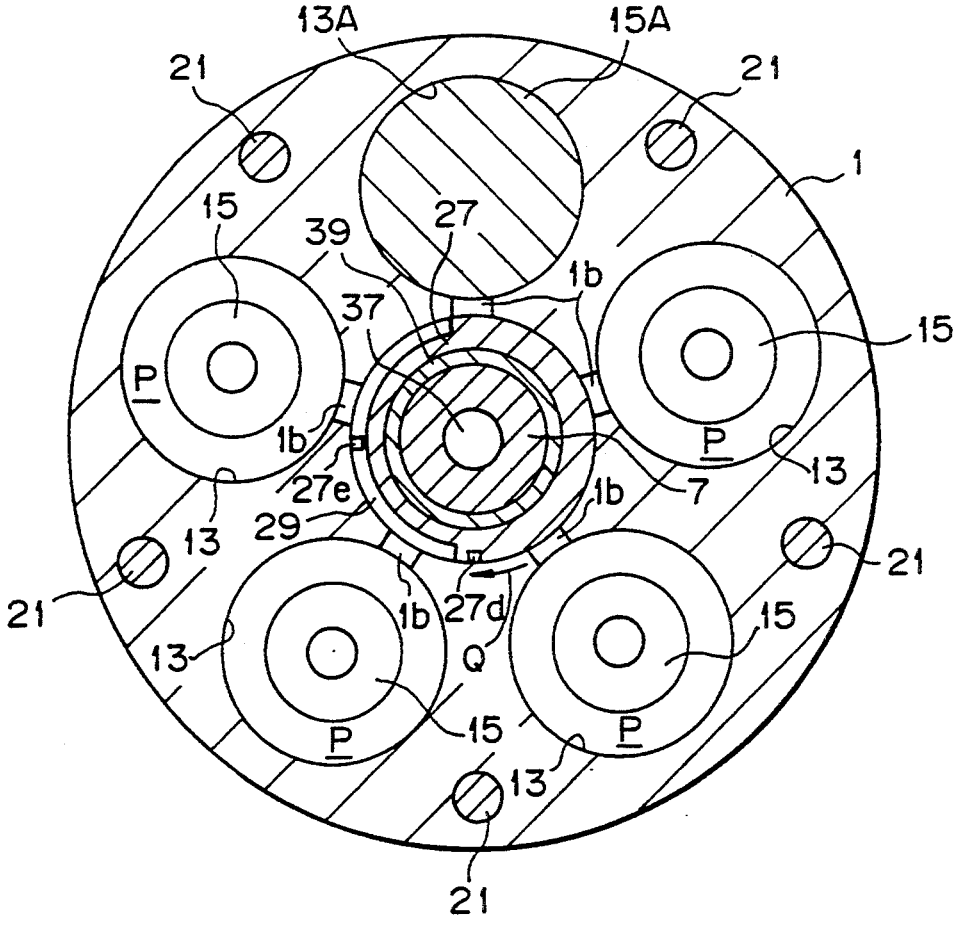
FIG. 4 is a cross-sectional view of the compressor taken along the line A—A of FIG. 1.
Figure 5:
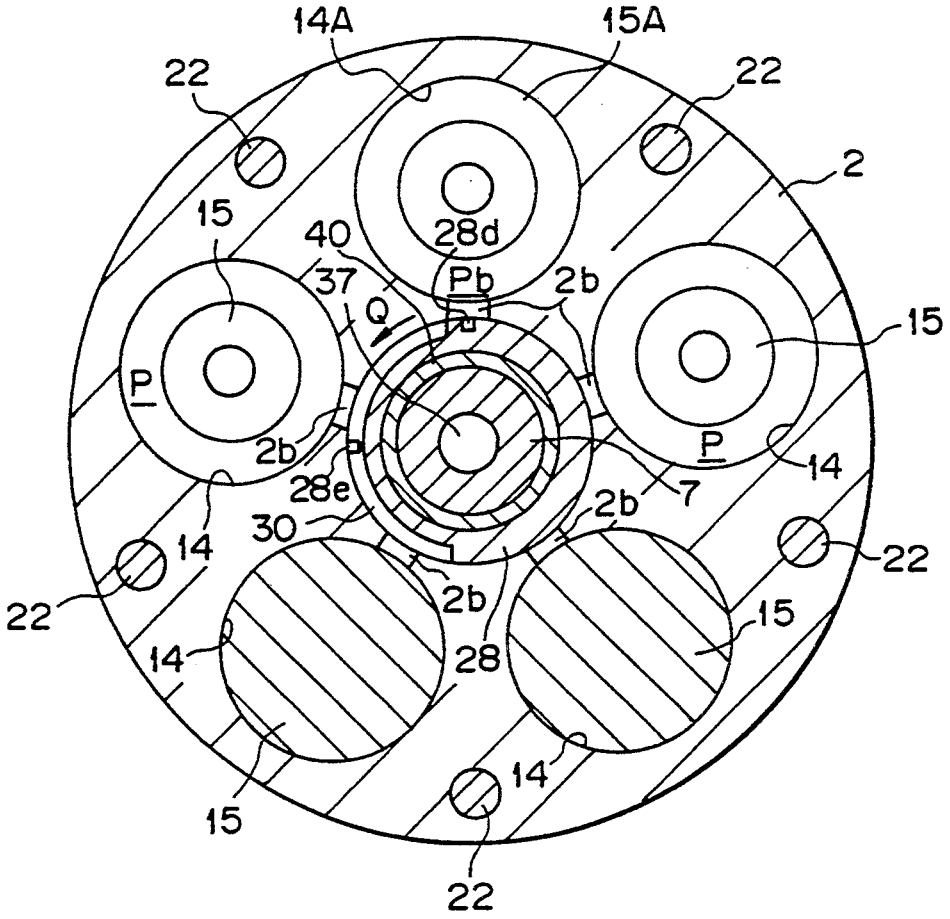
FIG. 5 is a cross-sectional view of the compressor, taken along the line B—of FIG. 1.

The front cylinder block 1 is provided with a plurality of cylinder bores 13, and the rear cylinder block 2 is provided with a plurality of cylinder bores 14. The cylinder bores 13 and 14 are axially aligned to form a plurality of pairs (fice pairs in the illustrated embodiment), and the plurality of pairs of cylinder bores 13 and 14 are equi-angularly arranged around an axis of rotation of the drive shaft 7, as best shown in FIGS. 3 and 5. It should be noted that the cylinder bores out of the plurality of cylinder bores 13 and 14 shown in FIG. 1 in addition to FIGS. 4 and 5 are particularly designated by reference numerals 13A and 14A, respectively.

In each of the pairs of cylinder bores 13, 14, 13A and 14A, a reciprocatory double-headed piston 15 (the piston in the cylinder bores 13A and 14A is designated by 15A) is received so as to be moved in a reciprocating manner. Each of the double-headed pistons 15, 15A is centrally engaged with both faces of the swash-plate 10 via a pair of semi-spherical shoes 16 and 17, and accordingly, when the swash-plate 10 is rotated together with the drive shaft 7, the pistons 15, 15A are axially reciprocated in respective cylinder bores 13, 14, 13A and 14A.

A front housing 18 is air-tightly attached to the outer face of the front valve plate 3, and a rear housing 19 is air-tightly attached to the outer face of the rear valve plate 4.

Figure 6:
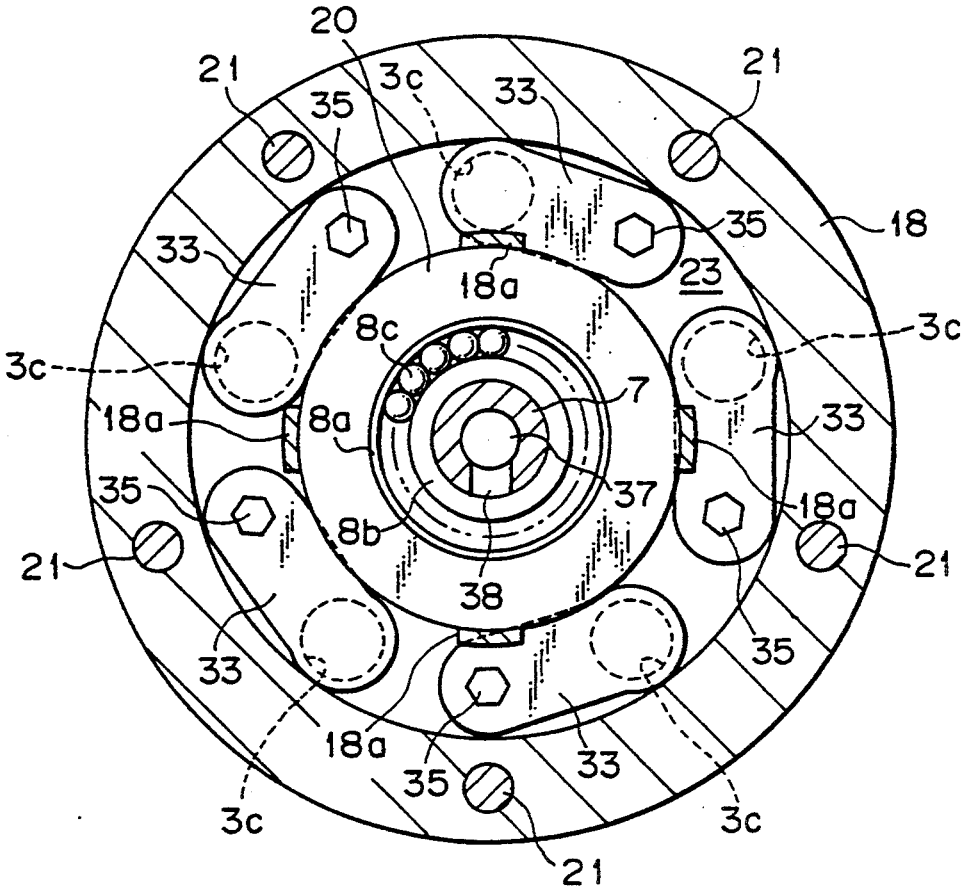
FIG. 6 is a cross-sectional view of the compressor, taken along the line C—C of FIG. 1.
Figure 7:
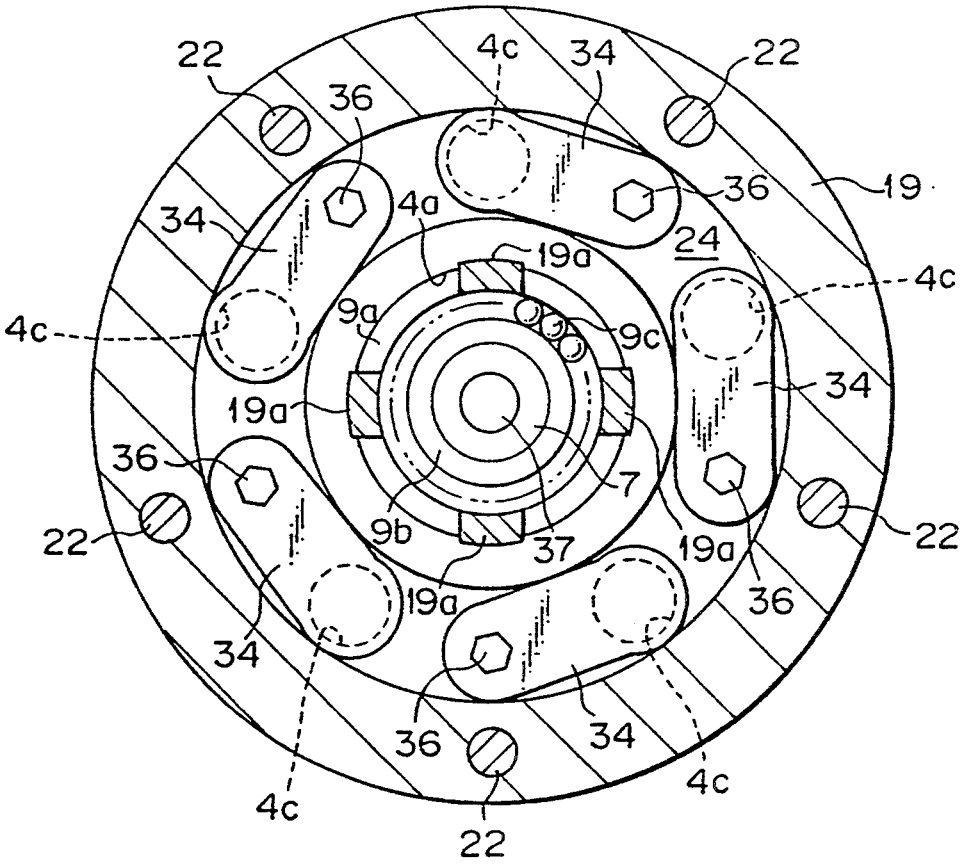
FIG. 7 is a cross-sectional view of the compressor, taken along the line D—D of FIG. 1.

The front and rear housings 18 and 19 are provided with a plurality of support projections 18*a* and 19*a*, respectively, which inwardly project from respective inner faces of both housings 18 and 19. The arrangement of the support projections 18*a* and 19*a* is best shown in FIGS. 6 and 7, respectively.

The support projections 18*a* of the front housing 18 axially support the outer race 8*a* of the front tapered-roller bearing 8 via an annular-shape leaf spring 20 which applies a preload to the outer race 8*a* of the bearing 8. The suppport projections 19*a* of the rear housing 19 are directly engaged with the outer race 9*a* of the rear tapered-roller bearing 9.

The inner races 8*b* and 9*b* of the tapered-roller bearings 8 and 9 bear against shoulders of annular raised portions 7*a* and 7*b* of the drive shaft 7, respectively.

The front cylinder block 1, the front valve plate 3 and the front housing 18 are tightly connected together by scew bolts 21. When screwing the screw bolts 21, the leaf spring 20 is bent to thereby apply a preload to the front tapered-roller bearing 8, and accordingly, the preload is transmitted to the rear tapered-roller bearing 9 via the drive shaft 7. Namely, the drive shaft 7 is stably rotated due to the support of both tapered-roller bearings 8 and 9.

The front and rear cylinder blocks 1 and 2, the rear valve plate 4, and the rear housing 19 are tightly connected together by long screw bolts 22. Thus, the front and rear cylinder blocks 1 and 2, the front and rear valve plates 3 and 4, and the front and rear housings 18 and 19 constitute the body of the compressor.

The front and rear housings 18 and 19 of the compressor body are internally provided with discharge chambers 23 and 24, respectively, The discharge chambers 23 and 24 fluidly communicate with compression chambers Pa and Pb formed in respective pairs of cylinder bores 13 and 14, 13A 14A via discharge ports 3*c* and 4*c* provided in the front and rear valve plates 3 and 4. The compression chambers Pa and Pb of each pair of cylinder bores 13 and 14, e.g., 13A and 14A are defined by the double-headed piston 15, e.g., 15A (FIG. 1) as variable volume chambers in the cylinder bores 13A and 14A, and are in axial registration with the discharge ports 3*c* and 4*c*, respectively. Therefore, in the first embodiment shown in FIGS. 1 through 7, five front and five rear discharge ports 3*c* and 4*c* are formed in the front and rear valve plates 3 and 4, respectively. These discharge ports 3*c* and 4*c* are closed by flapper-type discharge valves 31 and 32, respectively, which are opened by the high pressure of the compressed refrigerant gas at final stage of compression of the refrigerant gas by the double-headed pistons 15, 15A. The discharge valves 31 and 32 are backed up by retainers 33 and 34, respectively, which determine the amount of opening of the flapper-type discharge valves 31 and 32. The discharge valves 31 and 32 and the retainers 33 and 34 are fixed by screw bolts 35 and 36 (FIGS. 6 and 7) to the front and rear valve plates 3 and 4, respectively. As shown in FIG. 1, the front discharge chamber 23 is communicated with the external refrigerating circuit via an outlet port 25 formed in the front housing 18.

The element designated by reference numeral 26 is a lip seal arranged around a front portion of the drive shaft 7 so as to prevent the compressed refrigerant gas from leaking from the discharge chamber 23 toward the outside of the compressor.

A pair of rotary valve elements 27 and 28 are mounted on the drive shaft 7 at the annular raised portions 7*a* and 7*b* thereof so as to be rotated together with the drive shaft 7 within the afore-mentioned valve receiving chambers 1*a* and 2*a* in a direction Q shown in FIGS. 4 and 5. The rotary valve elements 27 and 28 are also permitted to slightly move on the drive shaft 7 in the axial direction.

Seal rings 39 and 40 are arranged between the central inner bores 27*f* and 28*f* of respective rotary valve elements 27 and 28 and the outer circumference of the raised portions 7*a* and 7*b* of the drive shaft 7 so as to provide an air-tight condition therebetween.

Figure 2:
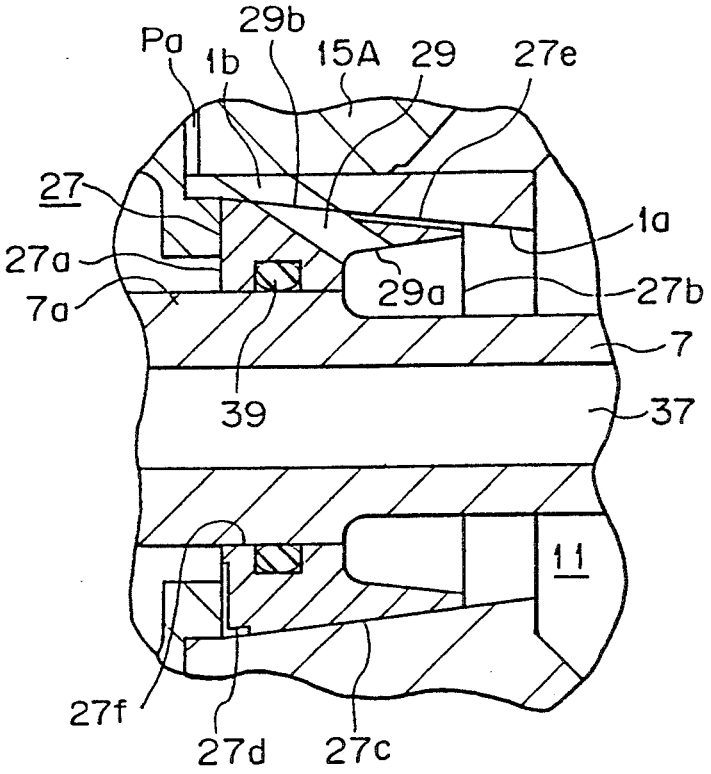
FIG. 2 is a partial cross-sectional view of a part of the compressor of FIG. 1, illustrating a detailed construction of a rotary valve element incorporated in the compressor.

As typically shown in FIG. 2, the valve receiving chamber 1*a* of the front cylinder block 1 is formed as an axially slanted or tapered bore having a cylindrical inner wall axially converging from the left-hand end of the cylinder block 1 toward the center of the compressor body. The valve receiving chamber 2*a* of the rear cylinder block 2 has a similar construction to that of the above-mentioned valve receiving chamber 1*a*.

The rotary valve elements 27 and 28 are provided with tapered outer circumferences 27*c* and 28*c*, respectively, which can be complementarily fitted in the converging inner walls of the valve receiving chambers 1*a* and 2*a*. Namely, as will be understood from FIG. 2, one of the rotary valve elements 27 and 28, i.e., the rotary valve element 27 is arranged in such a manner that an end 27*a* of a large diameter portion thereof is directed toward the front discharge chamber 23, and an end 27*b* of a small diameter portion thereof is directed toward the swash-plate chamber 11. It should be understood that the rotary valve element 28 is similarly arranged. Thus, an end 28*a* of a large diameter portion of the valve element 28 is directed toward the rear discharge chamber 24, and an end 28*b* of a small diameter portion of the valve element 28 is directed toward the swash-plate chamber 11.

As shown in FIGS. 1 and 2, the rotary valve elements 27 and 28 are provided with suction passageways 29 and 30, respectively, which have inlets 29*a* and 30*a* opening toward the small diameter ends 27*b* and 28*b*, and outlets 29*b* and 30*b* opening in the tapered outer circumferences 27*c* and 28*c*, respectively.

As typically shown in FIG. 3, one of the rotary valve elements 27 and 28, e.g., the rotary valve element 27 is also provided with a first lubricant passageway 27*d* formed as an L-shape groove running through the end of the large diameter portion 27*a* and the tapered outer circumference 27*c*. The tapered outer circumference 27*c* of the rotary valve element 27 is also provided with a second lubricant passageway 27*e* formed as a linearly extending groove. The first lubricant passageway 27*d* in the tapered outer circumference 27*c* has an end thereof positioned adjacent to an end of the suction passageway 29 as will be understood from FIG. 3. Thus, the first lubricant passageway 27*d* can trap a part of the refrigerant gas flowing from the discharge chamber 23, and lubricate the tapered outer circumference 27*c* with mist-like or liquid lubricating oil carried by the refrigerant gas. Therefore, when the rotary valve element 27 is in close contact with the conical inner wall of the valve receiving chamber 1*a*, the contacting portion of the tapered outer circumference 27*c* of the rotary valve element 27 and the inner wall of the valve receiving chamber 1*a* is constantly lubricated.

The second lubricant passageway 27*e* of the rotary valve element 27 is provided for communicating between the small diameter end 27*b* confronting the swash-plate chamber 11 and the outlet 29*b* of the suction passageway 29, and therefore, a part of the refrigerant gas in the swash-plate chamber 11 is introduced into the second lubricating passageway 27*e*. Accordingly, mist-like or liquid oil contained in the refrigerant gas also constantly lubricates the tapered outer circumference 27*c* of the rotary valve element 27 during the rotation of the rotary valve element 27 in the valve receiving chamber 1*a*. Therefore, the rotary valve element 27 can smoothly rotate in the valve receiving chamber 1*a* while maintaining a close contact with the inner wall of the valve receiving chamber 1*a*. Consequently, long operating life of the valve itself as well as the valve receiving chamber 1*a* can be ensured. It should, however, be noted that the provision of the first and second lubricating passageways 27*d* and 27*e* is so designed that there is no direct communication between the swash-plate chamber 11 and the discharge chamber 23 which should be fluidly isolated from one another during the operation of the compressor.

The rotary valve element 28 arranged on the rear side of the compressor is also provided with identical first and second lubricating passageways 28*d* and 28*e* (FIG. 1) to thereby lubricate the tapered outer circumference 28*c* of the rotary valve element 28 during the operation of the compressor, and accordingly, the rotary valve element 28 can be smoothly rotated in the valve receiving chamber 2*a*.

Referring particularly to FIGS. 1 and 4, the inner wall of the valve receiving chamber 1*a* is provided with suction ports 1*b* the number of which is identical with the number of the front side cylinder bores 13, 13A. The suction ports 1*b* are arranged equiangularly so that one of the suction ports 1*b* opens toward one of the front side cylinder bores 13, 13A, and so that respective suction ports 1*b* may be successively communicated with the outlet 29*b* of the suction passageway 29 of the rotary valve element 27 in response to the rotation of the valve element 27.

Similarly, as shown in FIGS. 1 and 5, the inner wall of the valve receiving chamber 2*a* is provided with suction ports 2*b* the number of which is identical with the number of the rear side cylinder bores 14, 14A. The suction ports 2*b* are arranged equiangularly so that one of the suction ports 2*b* opens toward one of the rear side cylinder bores 14, 14A, and so that respective suction ports 2*b* may be successively communicated with the outlet 30*b* of the suction passageway 30 of the rotary valve element 28 in response to the rotation of the valve element 28.

The compressor illustrated in FIGS. 1, 4 and 5 is in a state where one of the plurality of double-headed reciprocating pistons 15, i.e., the piston 15A is moved to a position corresponding to the top dead center thereof with regard to the front side cylinder bore 13A, and accordingly, to the bottom dead center thereof with regard to the rear cylinder bore 14A. When the double-headed piston 15A is reciprocated to move the shown top dead center toward the bottom dead center thereby carrying out the suction stroke for the cylinder bore 13A, the rotary valve element 27 is rotated to a position where the suction passageway 29 of the valve element 27 is communicated with the compression chamber Pa of the cylinder bore 13A. Accordingly, the refrigerant gas before compression in the swash-plate chamber 11 is drawn into the compression chamber Pa of the cylinder bore 13A through the suction passageway 29.

While the double-headed reciprocating piston 15A is carrying out the suction stroke thereof with regard to the front side cylinder bore 13A, the same piston 15A is carrying out the discharge stroke thereof with regard to the rear side cylinder bore 14A by moving from the bottom dead center to the top dead center for the cylinder bore 14A. During the discharge stroke of the double-headed piston 15A with regard to the rear side cylinder bore 14A, the rotary valve element 28 is rotated to a position where the suction passagway 30 of the valve element 28 is isolated from the compression chamber Pb of the cylinder bore 14A. Accordingly, the compreseed refrigerant gas in the compression chamber Pb of the cylinder bore 14A moves the discharge valve 32 to the opening position thereof to thereby be discharged toward the discharge chamber 24 of the rear housing 19 via the discharge port 4c.

The above-described suction and discharge operation of the refrigerant gas carried out by the double-headed reciprocating-piston 15A in cooperation with the rotary valve elements 27 and 28 for the pair of cylinder bores 13A and 14*a* is identically realized by the other respective double-headed reciprocating-pistons 15 for the compression chambers P of the other pairs of cylinder bores 13 and 14 in cooperation with the rotary valve elements 27 and 28.

The drive shaft 7 have one end (a front end) outwardly projecting from the front housing 18 and the other end (a rear end) projecting into the rear discharge chamber 24 of the rear housing 19. The drive shaft 7 is centrally provided with an axial discharge passageway 37 opening toward the discharge chamber 24. The axial discharge passageway 37 centrally extends toward the front end thereof, and is communicated with the front side discharge chamber 23 via connecting ports 38. Namely, the front and rear discharge chambers 23 and 24 are mutually communicated via the discharge passageway 37 and the connecting ports 38. Consequently, the compressed refrigerant gas discharged in the discharge chamber 24 constantly flows into the discharge chamber 23.

From the foregoing description, it will be understood that the rotary valve elements 27 and 28 rotating with the drive shaft 7 are able to successively supply the plurality of pairs of cylinder bores 13, 14, 13A, and 14A with the refrigerant gas before compression without suffering from the afore-mentioned problems encountered by the conventional flapper-type suction-valves. Namely, the problems of delay of opening of the flapper-type suction-valves adversely affected by the lubricating oil attached to the valves, and the insufficient amount of suction of the refrigerant gas due to the resilience of the flapper type valves can be overcome by the rotary valve elements 27 and 28. The rotary valve elements 27 and 28 are able to permit the refrigerant gas before compression to immediately flow into the compression chambers Pa and Pb as soon as pressure level in the compression chambers Pa and Pb is below that prevailing in the swash plate chamber 11 in response to the reciprocation of the double-headed pistons 15. Accordingly, the reciprocating-piston type refrigerant compressor according to the first embodiment provided with the rotary valve elements 27 and 28 is able to exhibit an enhanced volumetric compression efficiency compared with the conventional compressor provided with the flapper type suction valves.

Further, since the refrigeration gas before compression in the swash plate chamber 11 is drawn into the compression chambers P (Pa and Pb) in respective pairs of cylinder bores 13, 14, 13A and 14A through the suction passageways 29 and 30 of the rotary valve elements 27 and 28, the front and rear cylinder blocks 1 and 2 do not need to have suction passageways as were provided in the cylinder blocks of the conventional reciprocating-piston type compressor. Moreover, since the compressed refrigerant gas in the rear discharge chamber 24 of the compressor of the present embodiment is collected itno the front discharge chamber 23 via the axial discharge passageway 37 of the drive shaft 7 and is delivered toward the external refrigerating circuit via the outlet port 25, the front and rear cylinder blocks 1 and 2 do not need to have discharge passageways.

The above-mentioned omission of the suction and discharge passageways from the front and rear cylinder blocks 1 and 2 enables it to reduce angular spacing between the two circumferentially neighbouring cylinder bores of the plurality of pairs of cylinder bores 13 and 14 in the front and rear cylinder blocks 1 and 2. Thus, it is possible to reduce the diameter of a circle along which the cylinder bores are arranged without reducing the bore diameter of respective cylinder bores 13, 14, 13A and 14A. Consequently, the diameter of cylinder blocks 1 and 2 can be reduced resulting in the reduction in the diameter and weight of the entire compressor.

Further, in the compressor of the first embodiment of the present invention, the refrigerant gas before compression can be quickly drawn into the compression chambers Pa and Pb of the pair of cylinder bores 13, 14, 13A and 14A as soon as the pressure level in the compression chambers becomes less than that in the swash plate chamber 11 during the reciprocation of the double-head reciprocating pistons 15, 15A via the shorter suction passageways 29 and 30 of the rotary valve elements 27 and 28 compated with the conventional compressor. Therefore, the flow resistance to which the refrigerant gas before compression is subjected during the suction process thereof can be small. Accordingly, pressure loss during the suction of the refrigerant gas can be appreciably reduced resulting in improving the compression efficiency of the compressor.

Furthermore, since the rotary valve elements 27 and 28 are provided with the tapered outer circumferences 27c and 28c capable of being in close contact with the slanted inner walls of the valve receiving chambers 1a and 2a, the refrigerant gas under high pressure does not leak from the discharge chambers 23 and 24 toward the swash plate chamber 11 through between the tapered outer circumferences 27c and 28c and the inner walls of the valve receiving chambers 1a and 2a during the operation of the compressor. Namely, the large diameter ends 27a and 28a of the rotary valve elements 27 and 28 are exposed to the discharge chambers 23 and 24, i.e., regions in which a high pressure of the compressed refrigerant gas prevails, and the small diameter ends 27b and 28b of the rotary valve elements 27 and 28 are directly exposed to the swash plate chamber 11 in which a low pressure of the refrigerant gas before compression prevails. Therefore, both rotary valve elements 27 and 28 rotating in the valve receiving chambers 1a and 2a are constantly urged toward respective positions where the tapered outer circumferences 27c and 28c thereof are in air-tightly contact with the tapered inner walls of the valve receiving chambers 1a and 2a during the operation of the compressor. Thus, there occurs no leakage of the compressed refrigerant gas between the tapered outer circumferences 27c and 28c and the inner walls of the valve receiving chambers 1a and 2a.

The seal rings 39 and are able to prevent the compressed refrigerant gas from leaking through between the central inner bores 27f and 28f of the rotary valve elements 27 and 28 and the outer surface of the drive shaft 7. At this stage, the rotary valve elements 27 and 28 and the drive shaft 7 are always rotated together, and accordingly, the seal rings 39 and 40 are not relatively rotated with respect to the valve elements 27 and 28 and the drive shaft 7. Thus, abrasion of the seal rings 39 and 40 does not occur.

From the foregoing, it is understood that, since the rotary valve elements 27 and 28 can completely prevent leakage of the compressed gas from the high pressure regions, i.e., the discharge chambers 23 and 24 toward the low pressure region, i.e., the swash plate chamber 11, the volumetric efficiency in the compression of the refrigerant gas performed by the compressor of FIGS. 1 through 7 can be improved.

It should also be appreciated that as the rotary valve elements 27 and 28 are incorporated in the compressor by only inserting the elements onto the raised portions 7a and 7b of the drive shaft 7, the assembly of the rotary valve elements can be simpler than in the case of the conventional flapper type valves resulting in making the operation of assembly of the entire compressor simpler.

Moreover, the rotary valve elements 27 and 28 provided with the tapered outer circumferences 27c and 28c are constantly maintained in air-tight contact with the valve receiving chambers 1a and 2a provided with the complementary tapered inner walls by using a pressure differential between pressures of the compressed refrigerant gas and that of the refrigerant gas before compression. Thus, even if the tapered outer circumferences 27c and 28a and the complementary tapered inner walls of the valve receiving chambers are frictionally worn out during the long operation of the compressor, the air-tight contact between the tapered outer circumferences 27c and 28c of the valve elements 27 and 28 and the tapered inner walls of the valve receiving chambers 1a and 2a is not changed. The unchanged air-tight contact between the two valve elements and the corresponding chambers can be obtained even if the coefficient of linear expansion of the valve elements 27 and 28 is different from that of the cylinder blocks 1 and 2. Thus, the rotary valve elements 27 and 28 can guarantee fluid isolation of the high pressure discharge chambers 23 and 24 from the low pressure swash plate chamber 11. A change in the temperature inside the compressor does not adversely affect on the air-tight sealing function of the rotary valve elements 27 and 28, and eventually, the rotary valve elements 27 and 28 may be made of known various plastic materials.

Figure 8:
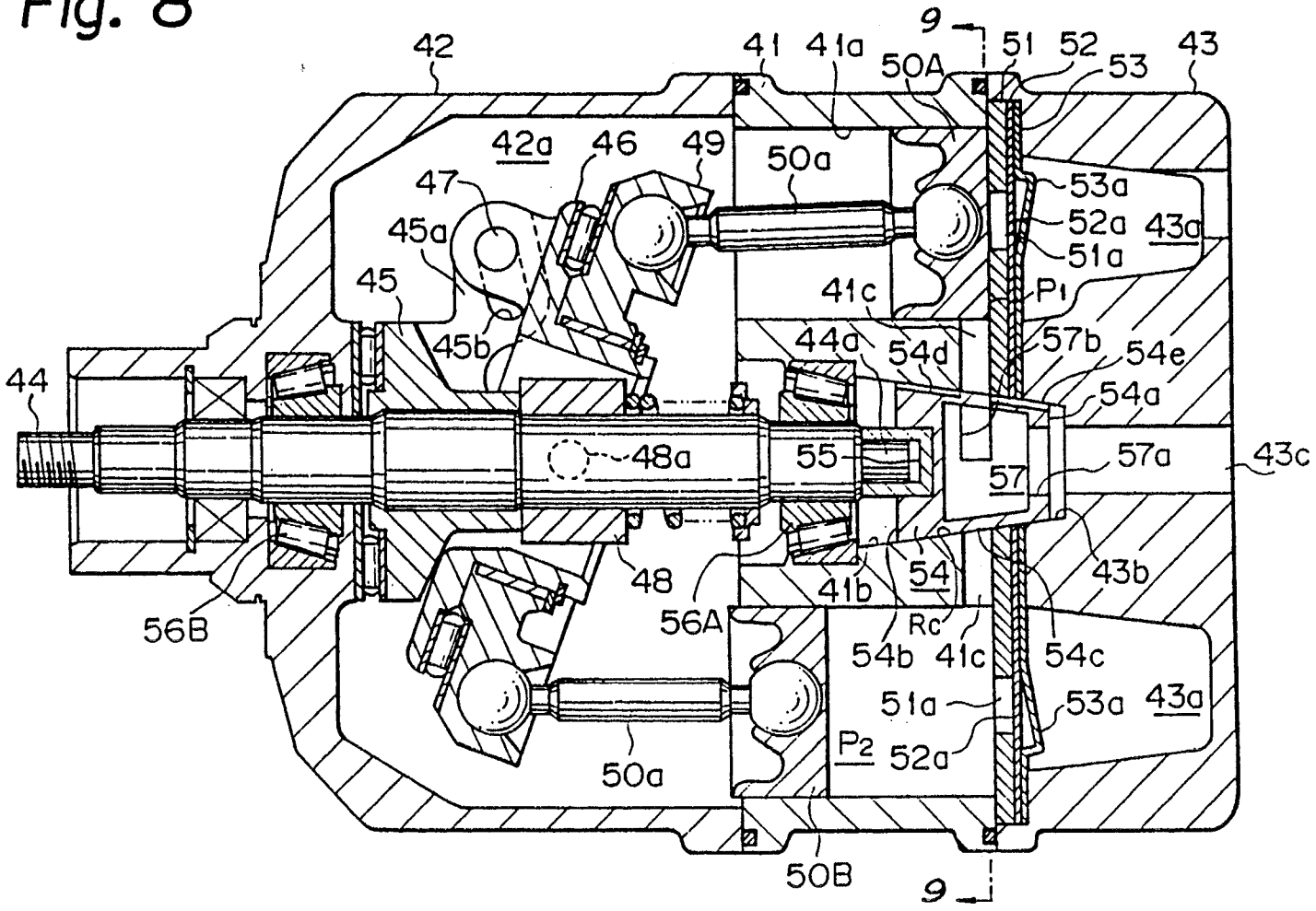
FIG. 8 is a longitudinal cross-sectional view of a reciprocating-piston-type compressor according to a second embodiment of the present invention, illustrating an internal construction thereof.
Figure 9:
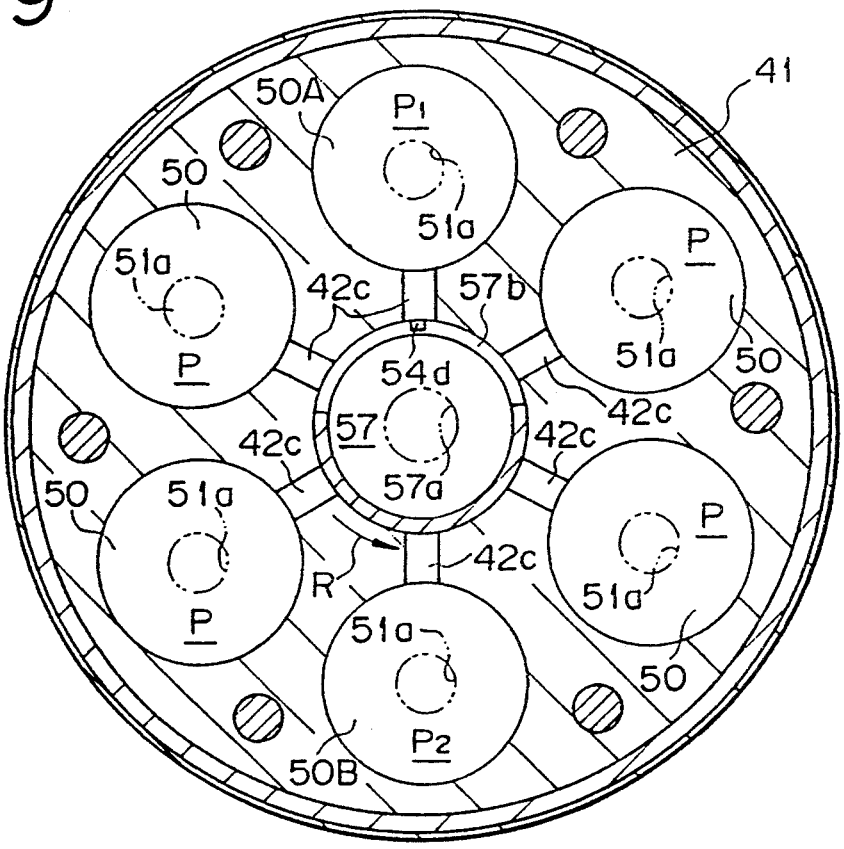
FIG. 9 is a cross-sectional view of the compressor, taken along the line E—E of FIG. 8.
Figure 10:
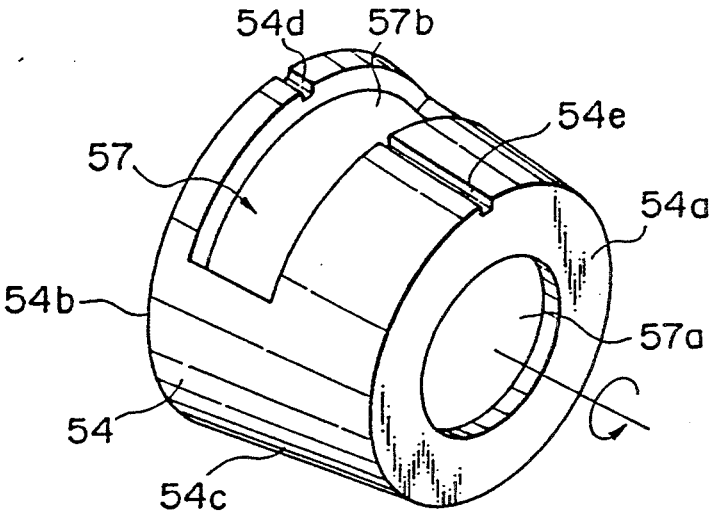
FIG. 10 is a perspective view of a rotary valve element incorporated in the compressor of FIG. 8.

FIGS. 8 through 10 illustrate the second embodiment of the present invention in which the reciprocating-piston type refrigerant compressor is a variable displacement wobble plate type refrigerant compressor having a plurality of reciprocating pistons.

In FIG. 8, the compressor includes a compressor body constituted by a cylinder block 41, and front and rear housings 42 and 43, and an axial drive shaft 44 rotatably supported by tapered-roller bearings 56A and 56B mounted in the cylinder block 41 and the front housing 42 of the compressor body.

A rotary support member 45 fixedly mounted on the drive shaft 44 is connected to a rotary drive member 46 via an arm 45a having an elongated through-hole 45b in which a pin 47 held by the rotary drive member 46 is movably engaged. The rotary drive member 46 is inclinably pivoted on trunnion pins 48a laterally projecting from a guide sleeve 48 which is mounted on the drive shaft 44 to be axially slidable. The rotary drive member 46 supports thereon a non-rotatable wobble plate 49 via a thrust bearing and an annular slide bearing fitted on a cylindrical flange portion of the drive member 46.

The wobble plate 49 is operatively connected to a plurality of reciprocatory single-headed pistons 50, 50A, 50B slidably received in a corresponding number of cylinder bores 41a (six bores in the shown embodiment) via respective connecting rods 50a.

The rotation of the drive shaft 44 is converted into a nutational motion of the wobble plate 49 about the trunnion pins 48a via the rotary support and drive members 45 and 46. Thus, the nutation of the wobble plate 49 causes reciprocation of the plurality of single-headed pistons 50, 50A, 50B in respective cylinder bores 41a.

A valve plate 51, a valve forming plate 52, and a retainer plate 53a are arranged between the rear end of the cylinder block 41 and the rear housing 43 in a tightly fixed condition. The rear housing 43 has an annularly extending discharge chamber 43a defined therein and fluidly communicated with compression chambers P, $P_1$, $P_2$ formed in respective cylinder bores 41a via discharge ports 51a provided in the valve plate 51. Discharge reed valves 52a formed in the valve forming plate 52 are arranged so as to openably close the discharge ports 52a at the side thereof confronting the discharge chamber 43a . The retainer plate 53a is arranged for determining an amount of opening of the discharge reed valves 52a.

The above-described compressor body has a valve receiving chamber Rc formed by two continguous bore-like chambers 41b and 43b. The former chamber 41b is centrally formed in the rear end portion of the cylinder block 41, and the latter chamber 43b is centrally formed in the end portion of the rear housing 43. A rear end 44*a* of the drive shaft 44 is projected into the chamber 41*b* of the valve receiving chamber Rc.

The valve receiving chamber Rc is generally formed as an axially convergent conical chamber having a small diameter portion thereof at rearmost end of the chamber 43*b*, and a large diameter portion thereof at the frontmost end of the chamber 41*b*. Within the valve receiving chamber Rc is arranged a rotary valve element 54 having a conically tapered outer circumference4 54*c* complementary with an inner tapered wall of the valve receiving chamber Rc.

As clearly shown in FIG. 8, a rear small diameter end 54*a* of the rotary valve element 54 confronts the rearmost end of the tapered chamber 43*b* via a small spacing therebetween. A large diameter end 54*b* of the rotary valve element 54 is connected to the rear end 44*a* of the drive shaft 44 via a coupling member 55 fitted in a central hole of the large diameter end 54*b*. The rear end 44*a* of the drive shaft 44 is fitted in the coupling member 55 in a non-rotatable manner but in an axially slidable manner. The rotary valve element 54 can rotate in the valve receiving chamber Rc in a predetermined direction shown by an arrow R in FIG. 9.

The rotary valve element 54 is provided with a cavity-like suction passageway 57 having an inlet 57*a* formed in the small diameter end 54*a* located in the chamber 43*b* of the rear housing 43, and an outlet 57*b* formed in the tapered outer circumference 54*c* at a position adjacent to the large diameter end 54*b*. The inlet 57*a* of the suction passageway 57 is communicated with an inlet port 43*c* of the rear housing 43 provided for introducing refrigerant gas from an external refrigerating circuit. The inlet port 43*c* in the form of an axial bore formed in the center of the rear housing 43 so as to be contingous with the chamber 43*b* of the valve receiving chamber Rc. Thus, the refrigerant gas returning from the external refrigerating circuit is constantly introduced into the suction chamber 57 of the rotary valve element 54. The outlet 57*b* of the suction passageway 57 has the form of a circumferential aperture as best shown in FIG. 10.

A plurality of suction ports 41*c*, the number of which is identical with that of cylinder bores 41*a*, are provided in the cylinder block 41 so as to be arranged around the chamber 41*b* of the valve receiving chamber Rc at an equal angular spacing. Each of the suction ports 41*c* radially extends, and has an inner end opening in the inner wall of the valve receiving chamber Rc, and being able to be cyclically communicated with the suction passageway 57 via the circumferential outlet 57*b*.

In FIGS. 8 and 9, the piston 50A is moved to a position corresponding to a top dead center thereof in the corresponding one of the cylinder bores 41*a*, and the piston 50B angularly spaced apart 180° from the piston 50A is moed to a position corresponding to a bottom dead center thereof in the corresponding one of the cylinder bores 41*a*. When the refrigerator gas is drawn in the compression chambers P, $P_1$, $P_2$, it is compressed in respective cylinder bores 41*a* by the pistons 50, 50A, 50B during the compression stroke of the pistons moving from the bottom dead center thereof toward the top dead center thereof. The compressed refrigerant gas is discharged from the compression chambers P, $P_1$, $P_2$ toward the discharge chamber 43*a* of the rear housing 43 at the final stage of the compression stroke of respective reciprocating-pistons 50, 50A, 50B.

As is well known, in the variable-displacement wobble-plate-type refrigerant compressor, the extent of the stroke of the respective pistons 50, 50A, 50B is changed in response to a change in a pressure differential between pressure prevailing in a crank chamber 42*a* of the front housing 42 and pressure prevailing in the discharge chamber 43*a* of the rear housing 43. The change in the extent of the stroke of the respective pistons 50, 50A, 50B causes a change in an angle of inclination of the wobble plate 49 with respect to a plane perpendicular to the axis of rotation of the drive shaft 44, and accordingly, the displacement of the compressor is varied. When the pressure level in the crank chamber 42*a* is controlled, the change in the above-mentioned displacement of the compressor can be adjustably changed, and the control of the pressure level in the crank chamber 42*a* can be achieved by supplying a high-pressure refrigerant gas into the crank chamber 42*a* and by appropriately evacuating the refrigerant as from the crank chamber 42*a* toward a suction pressure region, i.e., a region directly communicated with the inlet port 43*c* via a known displacement control valve mechanism (not shown in FIGS. 8 through 10).

The crank chamber 42*a* of the front housing 42 is constantly maintained at a pressure level higher than that in the suction pressure region.

During the operation of the compressor, the pressure prevailing in the crank chamber 42*a* acts on the large diameter end 54*b* of the rotary valve element 54, and the pressure prevailing in the inlet port 43*c* acts on the small diameter end 54*a* of the same element 54. Therefore, the rotary valve element 54 rotating in the valve receiving chamber Rc is axially pressed and moved in the valve receiving chamber Rc toward the rear end of the compressor body. Accordingly, the conical outer circumference 54*c* of the rotary valve element 54 is pressed against the tapered inner wall of the valve receiving chamber Rc, i.e., the tapered inner wall of the chambers 41*b* and 43*b*. Therefore, leakage of the refrigerant gas from the high pressure crank chamber 42*a* toward the low pressure inlet port 43*c* does not occur.

As clearly shown in FIG. 10, the rotary valve element 54 is provided with first and second lubricant passageways 54*d* and 54*e* similar to the first and second lubricant passageways 27*d* and 27*e* of the rotary valve element 27 (FIG. 2) of the afore-described first embodiment. The first lubricant passageway 54*d* is provided so as to be fluidly connected to the outlet 57*b* of the suction passageway 57 of the valve element 54. Thus, the first and second lubricant passageways 54*d* and 54*e* are able to supply mist-like or liquid oil, contained in the refrigerant gas, to the conically tapered outer circumference 54*c* of the rotary valve element 54 and the tapered inner wall of the conical chambers 41*b* and 43*b*. Therefore, not only smooth rotation of the rotary valve element 54 but also prevention of abrasion of the outer circumference of the same element 54 and the inner wall of the valve receiving chamber Rc can be ensured.

From FIGS. 8 and 10, it can be understood that the first and second lubricant passageways 54*d* and 54*e* of the rotary valve element 54 are formed so as to constantly provide a restricted fluid communication between the crank chamber 42*a* and the suction pressure region such as the inlet port 43*c* of the rear housing 43. Therefore, the first and second lubricant passageways 54*d* and 54*e* are able to function as passageways for permitting a blow-by gas in the crank chamber 42*a* to be returned to the suction pressure region.

A description of the third embodiment of the present invention will be provided below with reference to FIG. 11 in which elements and parts substantially identical with those of the first embodiment are designated by the same reference numerals and characters used with the first embodiment.

Figure 11:
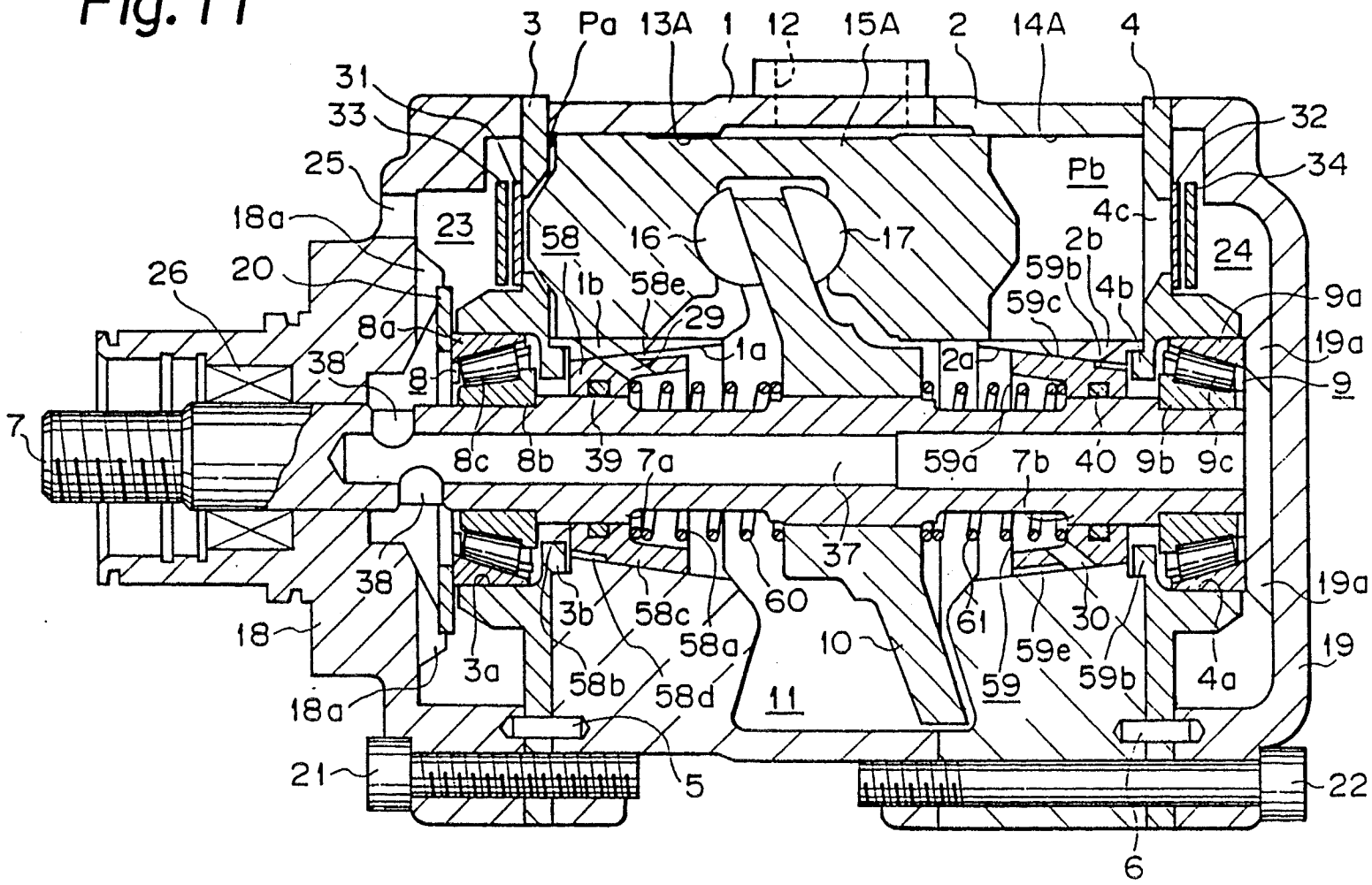
FIG. 11 is a longitudinal cross-sectional view of a reciprocating-piston-type compressor according to a third embodiment of the present invention, illustrating an internal construction thereof.

In FIG. 11, the reciprocating-piston type refrigerant compressor is formed as a swash plate type compressor having an internal construction substantially the same as the compressor of FIG. 1. Thus, the compressor of the third embodiment is provided with a plurality of double-headed reciprocating-pistons 15A, a corresponding number of pairs of front and rear cylinder bores 13A, 14A for receiving the double-headed pistons 15A, and a swash plate 10 mounted on a rotatable drive shaft 7 so as to be rotated in a swash plate chamber 11 which functions to receive refrigerant gas introduced from an external refrigerating circuit via an inlet port 12. The compressor is also provided with a pair of front and rear rotary valve elements 58 and 59 with tapered outer circumferences 58*c* and 59*c*, respectively. The rotary valve elements 58 and 59 are mounted on raised portions 7*a* and 7*b* of the drive shaft 7 so as to be rotated together, and received in bore-like valve receiving chambers 1*a* and 2*a* of the front and rear cylinder blocks 1 and 2.

The valve receiving chambers 1*a* and 2*a* are, however, provided with conical inner walls axially outwardly converging, respectively. Namely, the direction of slanting of the valve receiving chambers 1*a* and 2*a* is contrary to that with the first embodiment of FIG. 1. Therefore, pressure of the refrigerant gas prevailing in a suction pressure region, i.e., in the swash plate chamber 11, acts on large diameter ends 58*a* and 59*a* of the respective rotary valve elements 58 and 59, and pressure of the refrigerant gas in front and rear discharge chambers 23 and 24 acts on small diameter ends 58*a* and 59*b* thereof.

In the third emebodiment, a pair of springs 60 and 61 are incorporated in the rotary valve elements, respectively, which provide the valve elements 58 and 59 with pressure urging the elements in the axially outward directions, respectively. Namely, the springs 60 and 61 constantly urge both valve elements 58 and 59 toward their positions in sealing contact with the inner walls of the valve receiving chambers 1*a* and 2*a*.

The tapered outer circumferences 58*c* and 59*c* of the rotary valve elements 58 and 59 are provided with first lubricant passageways 58*d* and 59*d*, and second lubricant passageways 58*e* and 59*e*, respectively, formed therein as grooves similar to the grooved first and second lubricant passageways 27*d*, 28*d*, 27*e* and 28*e* of the rotary valve elements 27 and 28 of the first embodiment. These first and second lubricant passageways 58*d*, 59*d*, 58*e* and 59*e* lubricate the tapered outer circumferences 58*c* and 59*c* of the rotary valve elements 58 and 59, and the inner walls of the valve receiving chambers 1*a* and 2*a* with mist-like or liwuid oil contained in the refrigerant gas during the operation of the compressor.

Each of the springs 60 and 61 is designed and formed so as to be capable of exhibiting an elastic force overcoming pressure differential between pressures acting on both ends of of each of the respective rotary valve elements 58 and 59 so that the rotary valve elements 58 and 59 are constantly urged toward the positions in sealing contact with the inner walls of the respective valve receiving chambers 1*a* and 2*a*. That is, the spring force of the respective springs 60 and 61 is predetermined so as to be larger than the pressure differential between opposing pressures of the refrigerant gas acting on the large and small diameter ends 58*a*, 59*a*, 58*b* and 59*b* of the rotary valve elements 58 and 59, respectively. The spring force of the respective springs 60 and 61 should be, however, adjusted so as to prevent the valve elements 58 and 59 from being excessively forced against the inner walls of the valve receiving chambers 1*a* and 2*a* to thereby ensure smooth rotation of the rotary valve elements 58 and 59.

Figure 12:
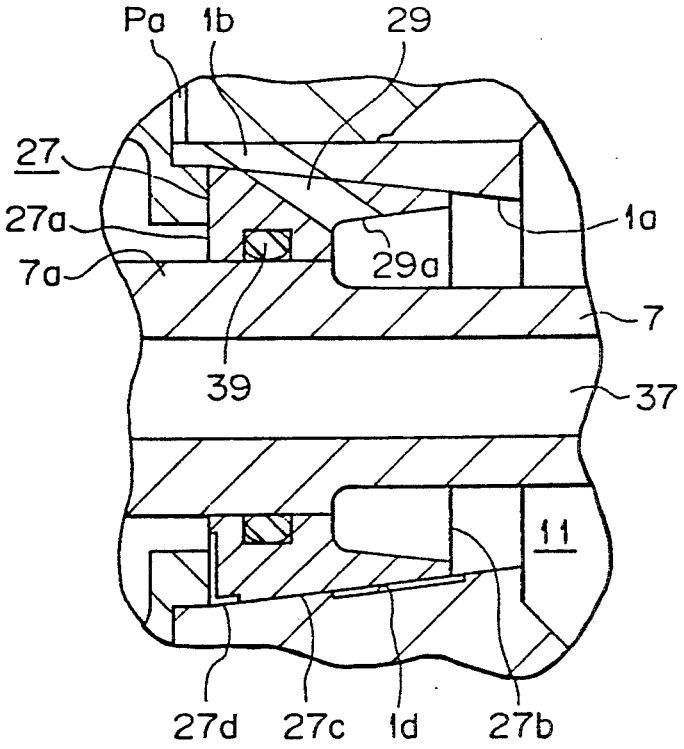
FIG. 12 is a partial enlarge cross-sectional view of a rotary valve element according to the present invention, illustrating an example of a lubricating system of the rotary valve element, different from that shown in FIG. 11.

FIG. 12 illustrates a modified arrangement of a rotary valve element in the corresponding valve receiving chamber of a reciprocating-piston type refrigerant compressor.

In FIG. 12, the rotary valve 27 identical with that used with the first embodiment of the present invention is mounted on the drive shaft 7, and rotatably received in the axially slanted inner wall of the valve receiving chamber 1*a*. Nevertheless, the inner wall of the valve receiving chamber 1*a* is formed with a lubricant passageway 1*d* which extends from a position adjacent to the small diameter end 27*b* of the valve element 27 toward a portion in contact with the tapered outer circumference 27*c* of the valve element 27 so as to lubricate the circumference 27*c* with mist-like or liquid oil contained in the refrigerant gas flowing into the suction passageway 29 of the valve element 27. Thus, the rotary valve element 27 may provided with only a first lubricant passageway. It should be appreciated that the arrangement of FIG. 12 may be adopted with the valve receiving chambers 2*a*, of the afore-described first and third embodiments and the chamber Rc of the second embodiment.

Figure 13:
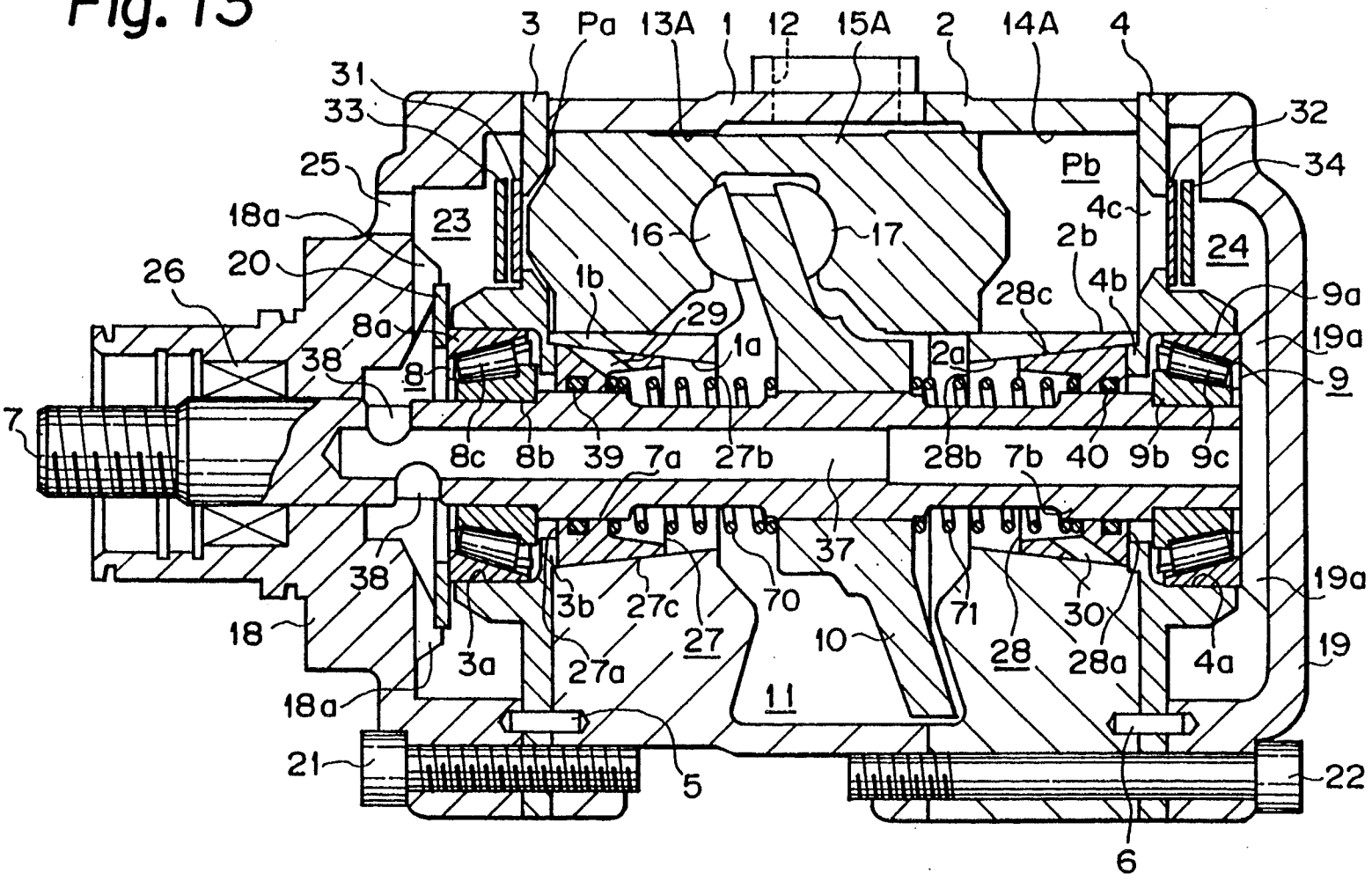
FIG. 13 is a longitudinal cross-sectional view of a reciprocating-piston-type compressor according to a fourth embodiment of the present invention, illustrating an internal construction thereof.
Figure 14:
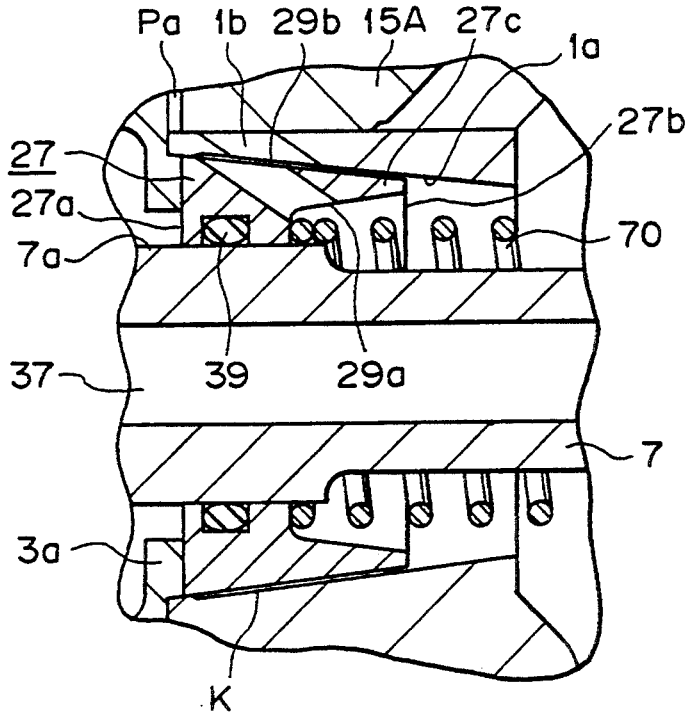
FIG. 14 is a partial enlarged cross-sectional view of a part of the compressor of FIG. 1, illustrating a rotary valve element which is incorporated in the compressor and elastically moved toward a position where an outer circumference of the valve element is separated from the internal wall of a valve receiving chamber.
Figure 15:
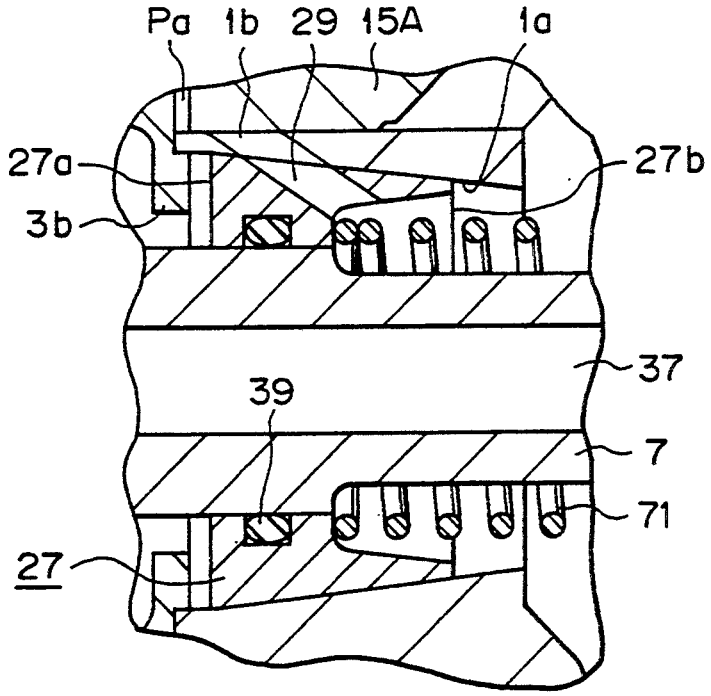
FIG. 15 is a cross-sectional view similar to that of FIG. 14, illustrating the rotary valve element which is set at a position where the outer circumference of the rotary valve element is in air-tight contact with the inner wall of the valve receiving chamber.

FIGS. 13 through 15 illustrate the fourth embodiment of the present invention in which the reciprocating-piston type compressor is again formed as a swash plate type double headed-piston type refrigerant compressor similar to the compressor of the first embodiment of FIG. 1. Therfore, elements and parts identical with those of the first embodiment are designated by the same reference numerals and characters. Further, a description of the basic internal construction of the compressor is omitted hereinbelow, and a novel construction employed in the present embodiment will be provided hereinbelow.

When the fourth embodiment of FIGS. 13 through 15 is compared with the first embodiment, it will be noted that the difference in the internal construction of the compressor between the two embodiments is that there are provided a pair of biasing springs 70 and 71 incorporated in the rotary valve elements 27 and 28 in such a manner that each of the springs 70 and 71 is disposed between the small diameter portion of each of the valve elements 27 and 28 and an inner shoulder of the drive shaft 7. Therefore, the biasing springs 70 and 71 constantly apply pressure to respective valve elements 27 and 28 so as to bias respective valve elements 27 and 28 toward the large diameter end portion of the valve receiving chambers 1*a* and 2*a*. The provision of the biasing springs 70 and 71 are advantage in that at the initial stage of the operation of the compressor after standstill thereof, the compressor can start the compression operation thereof without providing any physical or mechanical shock against a drive source of the compressor, e.g., a car engine.

In accordance with the disposition of the pair of biasing springs 70 and 71, when the compressor is stopped, discharge pressure of the refrigerant gas in the discharge chambers 23 and 24 is gradually lowered until it is substantially equal to suction pressure of the refrigerant gas before compression, received in the swash plate chamber 11. Accordingly, the combination of the biasing force of the springs 70 and 71 and the suction pressure of the refrigerant gas acting on the small diameter ends 27*b* and 28*b* of the rotary valve elements 27 and 28 is above the discharge pressure of the refrigerant gas acting on the large diameter ends 27*a* and 28*a* of the valve elements 27 and 28. Thus, the rotary valve elements 27 and 28 are moved from positions (FIG. 15) in contact with the inner walls of the valve receiving chambers 1*a* and 2*a* toward positions forming small gaps K between the tapered outer circumferences 27*c* and 28*c* of the valve elements and the inner walls of the valve receiving chambers 1*a* and 2*a*, respectively, as clearly shown in FIG. 14. When the small gaps K are formed, the rotary valve elements 27 and 28 are abutted against axial projections 3*a* and 3*b* of the front and rear valve plates 3 and 4. Consequently, the compression chambers P, Pa, Pb in the respective cylinder bores 13, 13A, 14, 14A are fluidly communicated with the gaps K of the rotary valve elements 27 and 28.

As soon as the operation of the compressor is started, a part of the refrigerant gas retained in the compression chambers in which the corresponding double-headed pistons start the discharge stroke thereof, flows toward the swash plate chamber 11 via the gaps K, and another part of the same refrigerant gas is discharged into the discharge chambers 23 and 24. On the other hand, a pressure level in the compression chambers in which the corresponding double-headed pistons start the suction stroke thereof, is lowered to a level below the pressure level in the swash plate chamber 11. Thus, the refrigerant gas flows from the swash plate chamber 11 toward the compression chambers under the suction stroke via the gap K. Namely, the gaps K function as bypassing passageways of the refrigerant gas communicating among all compression chambers of the cylinder bores 13, 13A, 14, 14A. Thus, at the initial stage of operation of the compressor, the pumping of the refrigerant gas is not suddenly started. Therefore, the start of the operation of the compressor does not cause an application of a large torque to the drive source of the compressor, e.g., a car engine of a car in which the compressor is mounted in order to compress the refrigerant gas of the car refrigerating system. As a result, a physical or mechanical shock is applied to the car and noise does not occur.

At the initial stage of operation of the compressor, the refrigerant gas is often liquefied, and the liquefied refrigerant will cause a large reactive force due to compression or pumping of the liquefied refrigerant. Such large reactive force adversely affects on the internal elements of the compressor. However, the gaps K between the rotary valve elements 27 and 28 and the inner walls of the valve receiving chambers 1*a* and 2*a* can permit the liquefied refrigerant to flow therethrough when pumped. Consequently, occurrence of physical or mechanical shock can be again prevented.

When the operation of the compressor is proceeded, a pressure level in the discharge chambers 23 and 24 is gradually increased. Thus, the discharge pressure acting on the large diameter ends 27*a* and 28*a* of the rotary valve elements 27 and 28 eventually becomes larger than addition of the spring force of the biasing springs 70 and 71 and the suction pressure acting on the small diameter ends 27*b* and 28*b* of the valve elements 27 and 28. Thus, the rotary valve elements 27 and 28 are urged toward positions shown in FIG. 15 in contact with the inner walls of the valve receiving chambers 1*a* and 2*a*. Therefore, leakage of the refrigerant gas from the discharge pressure region toward the suction pressure region can be prevented during the operation of the compressor.

Figure 16:
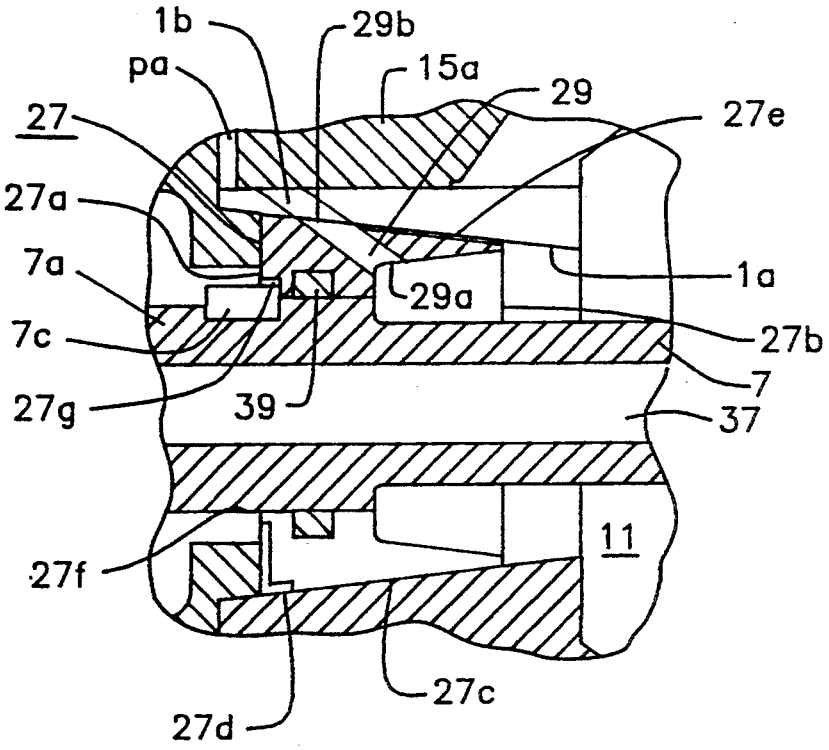
FIG. 16 is a cross-sectional view of a part of the compressor of FIG. 1, similar to FIG. 2 and illustrating a detailed engagement construction arranged between the rotary valve and the drive shaft of the compressor according to the first embodiment.

FIG. 16 illustrates the detailed structural relation ship between the rotary valve element 27 and the drive shaft 7 of the compressor of FIG. 1. As shown in FIG. 16, the end 27*a* of the rotary valve element 27 is provided with an axial key-groove 27*g* in which a key element 7*c* fixed to the drive shaft 7 is loosely fitted so that the rotary valve element 27 mounted on the drive shaft 7 is rotated integrally with the drive shaft 7 in the direction Q (FIGS. 4 and 5), and is slightly moved on the shaft in the axial direction in order to compensate for the frictional wear of the tapered outer circumference 27*c* and the complementary tapered inner wall of the valve receiving chamber 1*a*.

It should be understood that the engagement of the key element 7*c* and the key-groove 27*g* is provided so that a constant integral rotation of the drive shaft 7 and the rotary valve element 27 is ensured without a play.

Further, a similar key and key-groove engagement is provided between the drive shaft 7 and the rotary valve element 28 on the rear side of the compressor.

Figure 17:
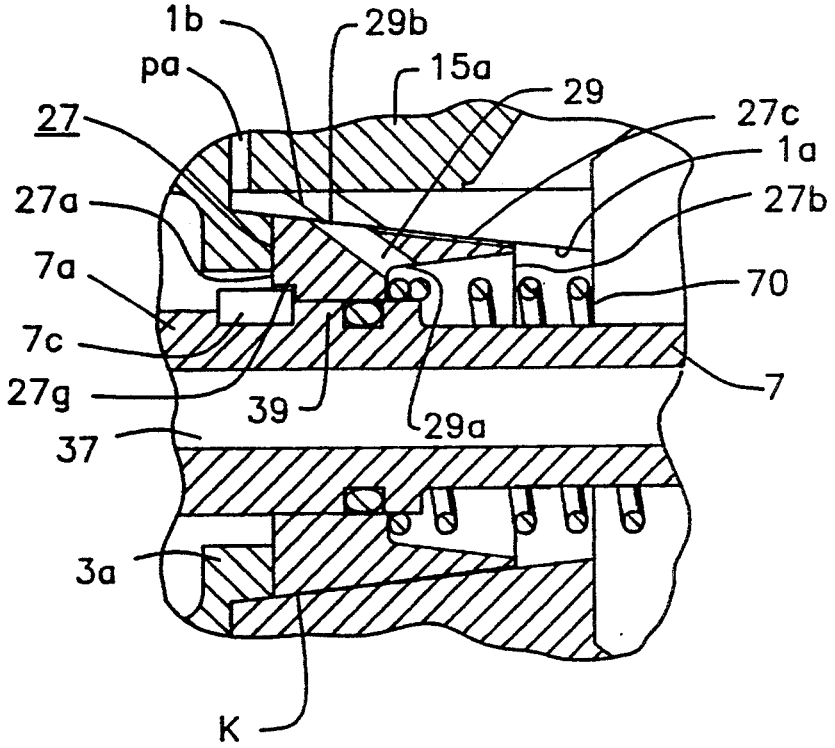
FIG. 17 is a cross-sectional view similar to FIG. 14, illustrating the relationship between the rotary valve element and the drive shaft of the compressor according to the fourth embodiment of FIG. 13 when the valve element is elastically moved on the drive shaft toward a position where the outer circumference of the valve element is separated from the internal wall of a valve receiving chamber.
Figure 18:
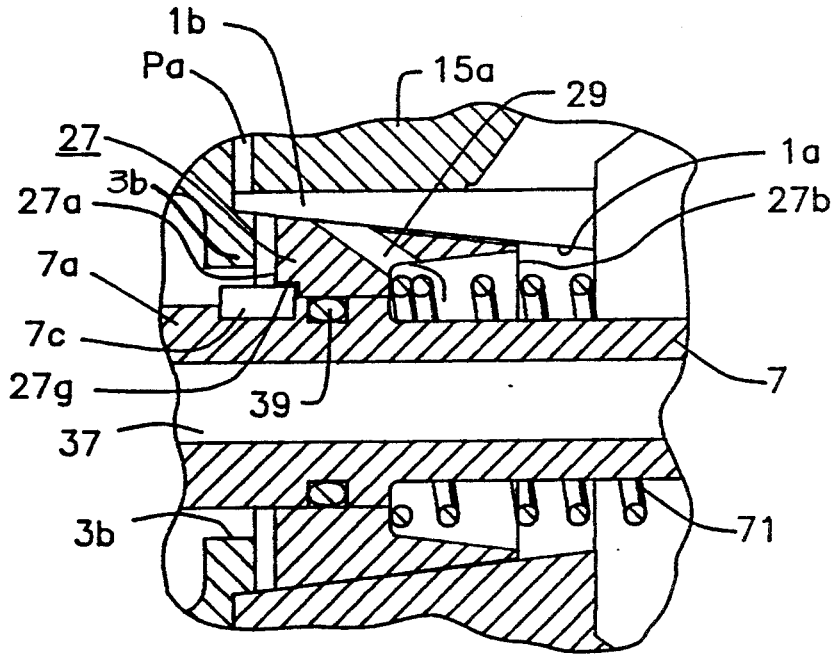
FIG. 18 is a cross-sectional view similar to that of FIG. 17, illustrating the structural relationship between the rotary valve element and the drive shaft when the valve element is set at a position where the outer circumference thereof is in air-tight contact with the inner wall of the valve receiving chamber.

FIGS. 17 and 18 illustrate a key and key-groove engagement provided between the drive shaft 7 and the rotary valve element 27 accommodated in the compressor of the embodiment shown in FIG. 13. Since the construction of the engagement of the key and key-groove is similar to that of FIG. 16, the description of the key element 7*c* and the key-groove 27*g* is omitted. Nevertheless, in the embodiment of FIGS. 17 and 18, the key-groove 27*g* of the rotary valve element 27 is made axially longer than that provided for the rotary valve element 27 of the compressor of the first embodiment. As a result, the rotary valve element 27 is axially positively moved between the positions shown in FIGS. 17 and 18. In this embodiment, a seal ring 39 is provided in an annular groove formed in the drive shaft 7. Thus, the integral rotation of the drive shaft 7 and the rotary valve element 27 as well as the axial movement of the rotary valve element 27 with respect to the drive shaft 7 are permitted with certainty. It should be understood that the rotary valve element 28 is provided with the same key and key-groove engagement as the above-mentioned rotary valve element 27.

Figure 19:
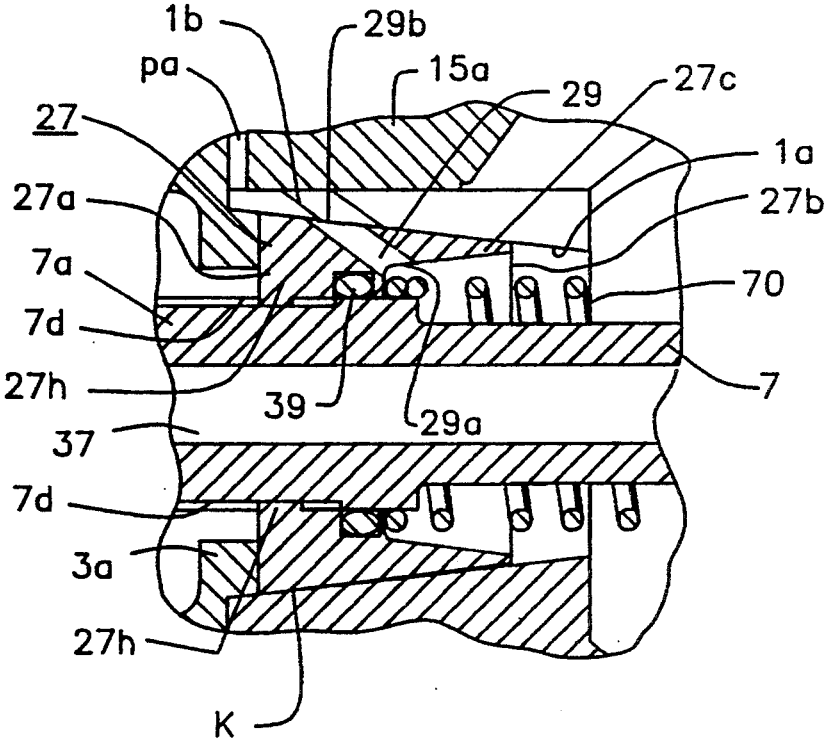
FIG. 19 is a cross-sectional view similar to FIG. 17, illustrating a modified structural relationship between the rotary valve element and the drive shaft when the valve element is elastically moved on the drive shaft toward a position where the outer circumference of the valve element is separated from the internal wall of a valve receiving chamber.
Figure 20:
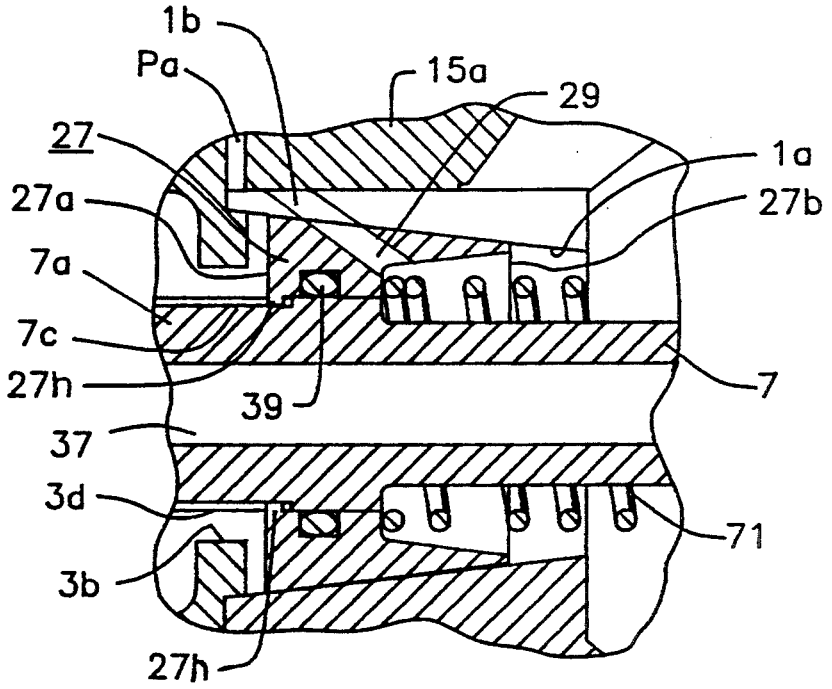
FIG. 20 is a cross-sectional view similar to FIG. 19, illustrating the modified structural relationship between the rotary valve element and the drive shaft when the valve element is set at a position where the outer circumference thereof is in air-tight contact with the inner wall of the valve receiving chamber.

FIGS. 19 and 20 illustrate a modification of the key and key-groove engagement shown in FIGS. 17 and 18 with respect to the rotary valve element 27 and the drive shaft 7 of the compressor.

In the key and key-groove engagement of FIGS. 19 and 20, the end 27*a* of the large diameter portion of the rotary valve element 27 is provided with a plurality of radial projections 27*h* acting as a key member, and the raised portion 7*a* of the drive shaft 7 is provided with a plurality of key-grooves 7*d* in which the radial projections 27*h* are fitted so that the integral rotation of the drive shaft 7 and the rotary valve element 27 as well as the axial movement of the rotary valve element 27 with respect to the drive shaft 7 are permitted.

It should be noted that the rotary valve element 28 mounted on the raised portion 7*b* of the drive shaft 7 is also provided with the same construction as the above-mentioned rotary valve element 27.

From the foregoing description it will be understood that according to the present invention, since the rotary valve element or elements provided with tapered outer circumferences or circumference are employed for the suction of the refrigerant gas into respective compression chambers of the reciprocating-piston type compressor, an immediate suction of a large amount of refrigerant gas into the compression chambers of respective cylinder bores is achieved. Therefore, the volumetric efficiency in the compression of the refrigerant gas is ensured. Further, the provision of the lubricant passageways in the rotary valve element or in the inner wall of the valve receiving chamber can guarantee a smooth rotation of the rotary valve elements during the operation of the compressor without causing abrasion of the valve element and the inner wall.

Furthermore, in the reciprocating-piston type compressor of the present invention, the diameter of the compressor body is reduced to thereby allow manufacturing of a small compressor with a performance comparable with that of a conventional compressor.

It should be understood that many variations and modifications will occur to a person skilled in the art without departing from the spirit and scope of the invention defined in the accompanying claims.

We claim:

1. A reciprocating-piston-type refrigerant compressor provided with a body including a cylinder block, an axial drive shaft rotatably supported in the body, at least one gas receiving chamber formed in the body for receiving refrigerant gas before compression, at least one gas discharge chamber formed in the body for receiving compressed refrigerant gas, a plurality of axial cylinder bores formed in the cylinder block of the body and arranged around an axis of rotation of the drive shaft, and a plurality of reciprocating-pistons axially slidably received in the plurality of cylinder bores and reciprocated in response to the rotation of the drive shaft, the reciprocating-pistons defining compression chambers in the plurality of cylinder bores, comprising:

a rotary valve means arranged to be rotatable with said drive shaft and having a suction pasageway for permitting suction of the refrigerant gas before compression from the gas receiving chamber into respective said compression chambers in a timed relationship with the reciprocation of said reciprocating pistons during rotation of said rotary valve means;

means for defining a recessed chamber in the body for rotatably receiving said rotary valve means, the recessed chamber being surrounded by an inner wall inclined relative to, and circumferentially extending around, the axis of rotation of said drive shaft;

said rotary valve means being provided with an outer circumferential wall inclined relative to the axis of rotation of said drive shaft so as to form two axially opposite small and large diameter end portions thereof, said outer circumferential wall being slidably fit in the inner wall of said recessed chamber; and means for providing a generally axial force on said rotary valve means thereby urging said rotary valve means in said recessed chamber in a direction such that said outer circumferential wall of said rotary valve means is in sealing contact with said inner wall of said recessed chamber.

2. A reciprocating-piston-type refrigerant compressor according to claim 1, wherein said compressor is a fixed displacement swash-plated-operated reciprocating-piston-type compressor, and wherein said gas receiving chamber is a swash-plate chamber for receiving therein said swash plate and having a gas inlet port capable of communicating with an external refrigerating circuit.

3. A reciprocating-piston-type refrigerant compressor according to claim 1, wherein said compressor is a variable displacement wobble-plate-operated reciprocating-piston-type compressor, and wherein said gas receiving chamber, comprises a refrigerant inlet port formed in said body so as to introduce said refrigerant gas before compression from an external refrigerating circuit.

4. A reciprocating-piston-type refrigerant compressor according to claim 1, wherein at least one of said outer circumferential wall of said rotary valve means and said inner wall of said recessed chamber is provided with a grooved recess for supplying said outer circumferential and inner walls with lubricant oil suspended in said refrigerant gas before compression and in said compressed refrigerant gas.

5. A reciprocating-piston-type refrigerant compressor according to claim 4, wherein said outer circumferential wall of said rotary valve means is provided with said groove recess for lubricant supply, and wherein said grooved recess comprises a first recessed passageway formed in said large diameter portion of said axially slanted outer circumferential wall, and a second recessed passageway formed in said small diameter portion of said inclined outer circumferential wall, said first and second recessed passageways being spaced apart from one another.

6. A reciprocating-piston-type refrigerant compressor according to claim 5, wherein said second recessed passageway fluidly communicates with said gas receiving chamber, and wherein said first recessed passageway communicates with a region in which a refrigerant gas having a pressure higher than that of said refrigerant gas before compression prevails.

7. A reciprocating-piston-type refrigerant compressor according to claim 1, wherein said rotary valve means is provided with two pressure receiving ends disposed at said small and large diameter end portions of said outer circumferential wall, and wherein said means for providing axial force on said rotary valve means comprises a pressure applying means for applying two different pressures of said refrigerant gas to said two pressure receiving ends of said rotary valve means, a pressure differential between said two different pressures applied on said two pressure receiving ends urging said rotary valve means in the direction such that said outer circumferential wall of said rotary valve means is in sealing contact with said inner wall of said recessed chamber.

8. A reciprocating-piston-type refrigerant compressor according to claim 7, wherein said suction passageway of said rotary valve means is formed in said outer circumferential wall thereof having a gas inlet aperture opening toward said gas receiving chamber and a gas outlet aperture capable of opening toward each of said plurality of said compression chambers in said plurality of cylinder bores in the timed relationship with the reciprocation thereof.

9. A reciprocating-piston-type refrigerant compressor according to claim 2, wherein said rotary valve means is mounted on said drive shaft, and wherein one of said two pressure receiving ends which is disposed at said small diameter end portion of said outer circumferential wall of said rotary valve means is exposed to said gas receiving chamber and the other of said two pressure receiving ends which is disposed at said large diameter end portion of said outer circumferential wall of said rotary valve means is exposed to said gas discharge chamber.

10. A reciprocating-piston-type refrigerant compressor according to claim 7, further comprises:

an elastic means for applying a generally axial elastic force to said rotary valve means in a direction against said axial force applied by said means for providing axial force, said axial elastic force urging said outer circumference of said rotary valve means to move away from said inner wall of said recessed chamber when said pressure differential between said two different pressures applied on said two pressure receiving ends of said rotary valve means is smaller than a, predetermined level.

11. A reciprocating-piston-type refrigerant compressor according to claim 7, wherein said two different pressures of said refrigerant gas are pressure of said refrigerant gas in said gas receiving chamber and pressure of said refrigerant gas in a higher pressure region.

12. A reciprocating-piston-type refrigerant compressor according to claim 11, wherein said higher pressure region is said gas discharge chamber.

13. A reciprocating-piston-type refrigerant compressor provided with a body including a cylinder block having a plurality of axial cylinder bores formed therein so as to be arranged around an axis of rotation of a drive shaft rotatably supported in the body, a swash plate mounted on the drive shaft to be rotated together with the drive shaft, a plurality of double-headed reciprocating-pistons axially slidably received in the plurality of cylinder bores and reciprocating in response to the rotation of the swash plate, the double-headed pistons defining a pair of compression chambers in each of the plurality of cylinder bores, a gas receiving chamber formed in the body for receiving refrigerant gas before compression, axially spaced discharge chambers formed in said body, respectively, for receiving compressed refrigerant gas, comprising:

rotary valve elements mounted on axially spaced positions of said axial drive shaft to be rotatable with said drive shaft, each rotary valve element having a suction passageway for permitting suction of the refrigerant gas before compression from said gas receiving chamber into one of said pair of compression chambers of said plurality of cylinder bores in a timed relationship with the reciprocation of said reciprocating double-headed pistons during rotation of said rotary valve element;

means for defining recessed chambers in the body for rotatably receiving said rotary valve elements, each recessed chamber being surrounded by an inner wall inclined relative to, and circumferentially extending around, the axis of rotation of said drive shaft;

each of said rotary valve elements being provided with an outer circumferential wall inclined relative to the axis of rotation of said drive shaft so as to form two axially opposite small and large diameter end portions thereof, said outer circumferential wall being slidably fit in the inner wall of one of said recessed chambers; and means for applying pressure of said refrigerant gas before compression to said small diameter end portion of each of said rotary valve elements and for applying pressure of said compressed refrigerant gas to said large diameter end portion of each of said rotary valve elements to thereby move said rotary valve element in each of said recessed chambers in a direction such that said outer circumferential wall of said rotary valve element is in sealing contact with said inner wall of said recessed chamber.

14. A reciprocating-piston-type refrigerant compressor according to claim 13, wherein at least one of said outer circumferential walls of each of said rotary valve elements and said inner walls of each of said recessed chambers is provided with a grooved recess for supplying said outer circumferential and inner walls with lubricating oil suspended in said refrigerant gas before compression and in said compressed refrigerant gas.

15. A reciprocating-piston-type refrigerant compressor according to claim 13, wherein said gas receiving chamber for receiving said refrigerant gas before compression comprises a swash plate chamber formed in said body for housing therein said swash plate, said swash plate chamber being provided with a suction inlet port capable of communicating with an external refrigerating circuit.

16. A receiprocating-piston-type refrigerant compressor according to claim 13, wherein each of said rotary valve elements is provided with two pressure receiving ends disposed at said small and large diameter end portions of said outer circumferential wall, and wherein said pressure applying means applying pressure of said refrigerant gas before compression to one of said two pressure receiving ends which is disposed at said small diameter end portion and applying pressure of said compressed refrigerant gas to the other of said two pressure receiving ends which is disposed at said large diameter end portion of said rotary valve means, a pressure differential between said pressures applied on said two pressure receipt ends urging said rotary valve means in the direction such that said outer circumferential wall of each of said rotary valve element is in sealing contact with said inner wall of one of said recessed chambers.

17. A reciprocating-piston-type refrigerant compressor according to claim 16, further comprises:

an elastic means for applying a generally axial elastic force to each of said rotary valve elements in a direction such that said axial elastic force urges said outer circumference of said rotary valve element to move away from said inner wall of said recessed chamber when said pressure differential between said pressures applied on said two pressure receiving ends of said rotary valve elements is smaller than a predetermined level.

18. A reciprocating-piston-type refrigerant compressor according to claim 17, wherein sadi elastic means comprises coil springs, each being arranged at a position adjacent to said pressure receiving end disposed at said small diameter end portion of each of said rotary valve element to thereby constantly apply an axial spring force to said smalll diameter end portion.

* * * * *